US010495020B2

(12) United States Patent
Ikemoto

(10) Patent No.: US 10,495,020 B2
(45) Date of Patent: Dec. 3, 2019

(54) CONTROL SYSTEM INCLUDING CONTROL DEVICE FOR INTERNAL COMBUSTION ENGINE

(71) Applicant: Toyota Jidosha Kabushiki Kaisha, Toyota-shi Aichi-ken (JP)

(72) Inventor: Masato Ikemoto, Susono (JP)

(73) Assignee: Toyota Jidosha Kabushiki Kaisha, Toyota-shi Aichi-ken (JP)

( * ) Notice: Subject to any disclaimer, the term of this patent is extended or adjusted under 35 U.S.C. 154(b) by 36 days.

(21) Appl. No.: 15/862,776

(22) Filed: Jan. 5, 2018

(65) Prior Publication Data

US 2018/0195460 A1 Jul. 12, 2018

(30) Foreign Application Priority Data

Jan. 12, 2017 (JP) ..... 2017-003461

(51) Int. Cl.

| | |
|---|---|
| ***F02D 41/38*** | (2006.01) |
| ***F02M 47/02*** | (2006.01) |
| ***F02M 63/02*** | (2006.01) |
| ***F02M 55/02*** | (2006.01) |
| ***F02M 57/02*** | (2006.01) |

(52) U.S. Cl.

CPC ..... *F02D 41/3863* (2013.01); *F02M 47/027* (2013.01); *F02M 55/02* (2013.01); *F02M 55/025* (2013.01); *F02M 57/026* (2013.01); *F02M 63/023* (2013.01); *F02D 2200/0602* (2013.01); *F02D 2200/0606* (2013.01); *F02D 2200/0608* (2013.01); *F02D 2250/31* (2013.01)

(58) Field of Classification Search

CPC ..... F02D 41/3863; F02D 2200/0602; F02D 2200/0606; F02D 2200/0608; F02M 47/027; F02M 55/02; F02M 55/025; F02M 57/026; F02M 63/023

USPC ..... 123/506, 510

See application file for complete search history.

(56) References Cited

U.S. PATENT DOCUMENTS

| | | | | |
|---|---|---|---|---|
| 9,140,226 | B2 * | 9/2015 | Yoon | F02M 21/0212 |
| 2006/0144367 | A1 * | 7/2006 | Futonagane | F02D 41/3836 123/446 |

(Continued)

FOREIGN PATENT DOCUMENTS

| | | | |
|---|---|---|---|
| JP | 2003-106235 | A | 4/2003 |
| JP | 2004-108151 | A | 4/2004 |
| JP | 2007-127080 | A | 5/2007 |

*Primary Examiner* — Mahmoud Gimie

(74) *Attorney, Agent, or Firm* — Dinsmore & Shohl LLP

(57) ABSTRACT

A control system includes an internal combustion engine and a control device. The internal combustion engine includes a pressurization device. The pressurization device includes a housing having a cylindrical shape, a piston, a pressurization chamber, a piston chamber, a pressurization control chamber, and a switching device configured to selectively connect the pressurization control chamber with a high pressure fuel channel or a low pressure fuel channel. The control device estimates the temperature of the low pressure fuel channel. When the estimated temperature of the low pressure fuel channel is lower than the temperature of the pressurization device, and the temperature of the pressurization device is higher than a predetermined cooling request temperature, the control device controls the switching device to connect the pressurization control chamber with the low pressure fuel channel.

6 Claims, 12 Drawing Sheets

(56) References Cited

U.S. PATENT DOCUMENTS

| | | | | |
|---|---|---|---|---|
| 2006/0162695 | A1* | 7/2006 | Shibata | F02M 47/027 123/446 |
| 2007/0101972 | A1 | 5/2007 | Majima | |
| 2008/0264383 | A1* | 10/2008 | Omae | F02M 63/0015 123/445 |

* cited by examiner

CONTROL SYSTEM INCLUDING CONTROL DEVICE FOR INTERNAL COMBUSTION ENGINE

CROSS REFERENCE TO RELATED APPLICATION

This application claims priority to Japanese Patent Application No. 2017-003461 filed on Jan. 12, 2017, which is incorporated herein by reference in its entirety.

BACKGROUND

1. Technical Field

The present disclosure relates to a control system that includes a control device for an internal combustion engine.

2. Description of Related Art

A control device for an internal combustion engine in the related art is disclosed in Japanese Unexamined Patent Application Publication No. 2003-106235 (JP 2003-106235 A). The control device relates to an internal combustion engine in which fuel supplied from a common rail is further pressurized by a pressurization device and is injected by a fuel injection device. The control device is configured to control the pressure of injected fuel.

SUMMARY

The pressurization device includes a housing and a piston disposed inside the housing. The piston moves within the housing, and fuel supplied to a pressurization chamber formed within the housing from the common rail is pushed from the pressurization chamber by the piston. Thus, fuel is pressurized.

In addition to the pressurization chamber, a pressurization control chamber is formed within the housing of the pressurization device in order to control driving of the piston. The pressurization control chamber can be selectively connected to the common rail or a fuel tank. When the pressurization control chamber is connected to the common rail, fuel within the common rail fills the pressurization control chamber.

When the pressurization control chamber is connected to the fuel tank, fuel within the pressurization control chamber is discharged to the fuel tank. Accordingly, the pressure of the pressurization control chamber is decreased, and the piston moves within the housing. Consequently, fuel within the pressurization chamber is pushed from the pressurization chamber, and the fuel is pressurized.

As described above, when the pressurization device is driven in order to pressurize fuel, fuel that fills the pressurization control chamber from the common rail is discharged to the fuel tank. In such a case, the pressure of fuel filling the pressurization control chamber is decreased, and pressure energy is converted into thermal energy. Thus, the temperature of fuel discharged from the pressurization control chamber is increased.

When the temperature of fuel is increased, there is also an increase in temperature in the pressurization device, particularly, a three-way valve or an actuator for driving the three-way valve included in the pressurization device. When the state of the pressurization device at a high temperature continues for a long time period, the pressurization device may deteriorate.

The present disclosure provides a control device configured to control cooling of a pressurization device when the temperature of the pressurization device is increased.

An aspect of the present disclosure provides a control system. The control system includes an internal combustion engine and a control device. The internal combustion engine includes a fuel tank, a supply pump, a high pressure fuel channel in which fuel increased in pressure by the supply pump, a pressurization device, a low pressure fuel channel in which fuel returning to the fuel tank from the pressurization device without being increased in pressure by the pressurization device flows, and a fuel injection device. The supply pump is configured to increase a pressure of fuel retained in the fuel tank. The fuel injection device is configured to inject fuel increased in pressure by the pressurization device. The pressurization device is configured to increase the pressure of fuel supplied from the high pressure fuel channel. The pressurization device includes a housing, a piston, a pressurization chamber, a piston chamber, a pressurization control chamber, and a switching device. The housing has a cylindrical shape. The piston reciprocatingly movably accommodated within the housing. The piston is configured to pressurize fuel within the pressurization chamber by using the pressure of fuel supplied from the high pressure fuel channel to the piston chamber. The pressurization chamber is defined by a first end of the piston and the housing. The pressurization chamber is filled with fuel that is discharged toward the fuel injection device. The piston chamber is defined by a second end of the piston and the housing. The pressurization control chamber is defined by the piston and the housing, and is disposed between the pressurization chamber and the piston chamber. The pressurization control chamber is configured to discharge fuel that is supplied from the high pressure fuel channel to the low pressure fuel channel during pressurization of fuel in the pressurization chamber. The switching device is configured to selectively connect the pressurization control chamber with the high pressure fuel channel or the low pressure fuel channel. The control system includes a control device. The control device is configured to estimate the temperature of the low pressure fuel channel. The control device is configured to control the switching device to connect the pressurization control chamber with the low pressure fuel channel, when the estimated temperature of the low pressure fuel channel is lower than the temperature of the pressurization device, and the temperature of the pressurization device is higher than a predetermined cooling request temperature.

According to the aspect of the present disclosure, when the temperature of the pressurization device is higher than the predetermined cooling request temperature, and the pressurization device needs to be cooled, the pressurization device can be cooled.

In the control system, the control device may be configured to calculate a target injection fuel pressure that is a target value of the pressure of fuel supplied to the fuel injection device from the pressurization device when fuel injection is requested. The control device may be configured to calculate a target fuel pressure in the high pressure fuel channel based on the target injection fuel pressure. The control device may be configured to estimate a fuel temperature in the low pressure fuel channel based on the target fuel pressure.

In the control system, the control device may be configured to store a first map in which a first operating region determining an engine rotational speed and a target injected fuel amount causing a fuel temperature in the low pressure fuel channel to become lower than or equal to the predetermined cooling request temperature is set, and a second map in which the first operating region is not set. The control device may be configured to select the first map when the temperature of the pressurization device is higher than the predetermined cooling request temperature. The control device may be configured to select the second map when the temperature of the pressurization device is lower than or equal to the predetermined cooling request temperature; and connect the pressurization control chamber with the low pressure fuel channel when the engine rotational speed and the target injected fuel amount are included in the first operating region of the map selected from the first map and the second map.

In the control system, the control device may be configured to set a target fuel pressure in the high pressure fuel channel to a target fuel pressure causing a fuel temperature in the low pressure fuel channel to become lower than or equal to the predetermined cooling request temperature, when the fuel injection device is not requested to inject fuel, and the temperature of the pressurization device is higher than the predetermined cooling request temperature. The control device may be configured to control the supply pump such that the pressure of fuel within the high pressure fuel channel is to be the target fuel pressure. The control device may be configured to connect the pressurization control chamber with the low pressure fuel channel.

In the control system, the control device may be configured not to connect the pressurization control chamber with the low pressure fuel channel, when the estimated fuel temperature in the low pressure fuel channel is higher than the temperature of the pressurization device, and the temperature of the pressurization device is higher than the predetermined cooling request temperature.

In the control system, a second operating region that determines an engine rotational speed and a target injected fuel amount causing the fuel temperature in the low pressure fuel channel to become higher than the predetermined cooling request temperature may not be set in the first map. The second operating region may be set in the second map. The control device may be configured to connect the pressurization control chamber with the low pressure fuel channel when the engine rotational speed and the target injected fuel amount are included in the second operating region of the map selected from the first map and the second map.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Hereinafter, each embodiment of the present disclosure will be described in detail with reference to the drawings. In the following description, corresponding constituent elements will be designated with the same reference signs.

First Embodiment

Figure 1:
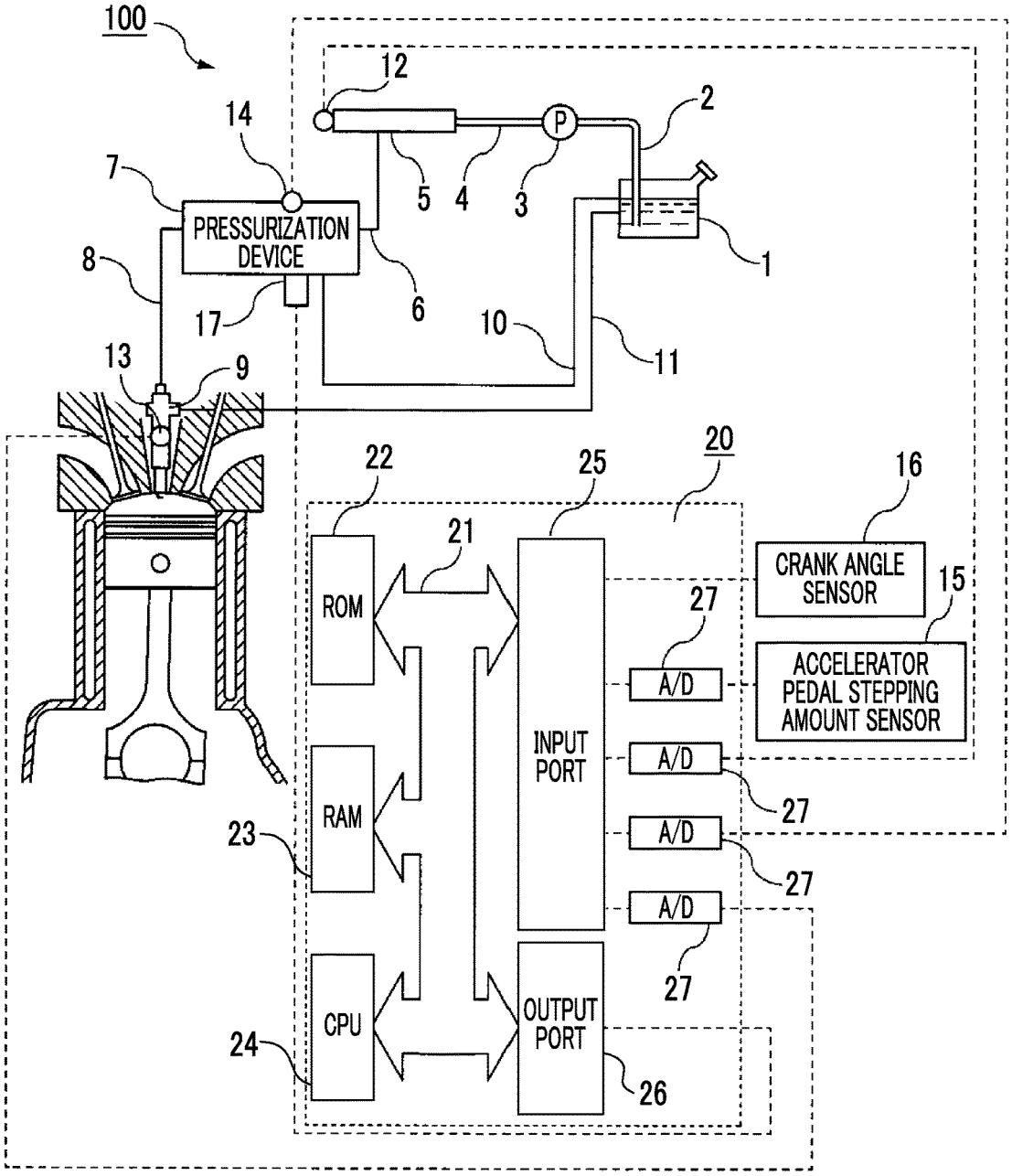
FIG. 1 is a schematic configuration diagram of an internal combustion engine and a electronic control unit controlling the internal combustion engine in an embodiment of the present disclosure.

FIG. 1 is a schematic configuration diagram of an internal combustion engine 100 and an electronic control unit 20 controlling the internal combustion engine 100 according to a first embodiment of the present disclosure.

The internal combustion engine 100 according to the present embodiment includes a fuel tank 1, a pump intake channel 2, a supply pump 3, a pump discharge channel 4, a common rail 5, a supply channel 6, a pressurization device 7, an injection channel 8, an injector 9, a return channel 10, and a relief channel 11.

The fuel tank 1 retains externally supplied fuel at ordinary pressure. The fuel retained in the fuel tank 1 is pumped by the supply pump 3 through the pump intake channel 2.

The supply pump 3 pumps and pressurizes the fuel retained in the fuel tank 1. The fuel pressurized by the supply pump 3 is supplied to the common rail 5 through the pump discharge channel 4. The amount of fuel discharged from the supply pump 3 can be controlled by the electronic control unit 20. By controlling the amount of fuel discharged from the supply pump 3, the pressure of fuel within the common rail 5 is controlled.

The common rail 5 retains the high pressure fuel supplied from the supply pump 3 through the pump discharge channel 4. The common rail 5 is connected to a plurality of supply channels 6 corresponding to cylinders, and distributes fuel toward each cylinder. The common rail 5 includes a common rail pressure sensor 12 for measuring the pressure of fuel retained within the common rail. In the following description, the pressure measured by the common rail pressure sensor 12 will be referred to as common rail pressure.

The pressurization device 7 is disposed in correspondence with each cylinder. The pressurization device 7 further pressurizes fuel supplied from the common rail 5 through the supply channel 6, and supplies the fuel to the injector 9 through the injection channel 8. When the pressurization device 7 pressurizes fuel, the pressurization device 7 discharges high pressure fuel supplied, from the common rail 5 to the fuel tank 1 through the return channel 10.

An actuator 17 for driving the pressurization device 7 is disposed in the pressurization device 7. The actuator 17 is likely to be damaged by being exposed to a high temperature. Thus, the temperature of the pressurization device 7, particularly, the temperature around the actuator 17 is controlled in order not to damage the actuator 17. In the present embodiment, a pressurization device temperature sensor 14 for measuring temperature is disposed near the actuator of the pressurization device 7.

The injector 9 is disposed in correspondence with each cylinder. The injector 9 injects fuel supplied from the pressurization device 7 to the cylinder through the injection channel 8. When the time period in which the injector 9 is opened is the same, the amount of fuel injected to the cylinder (injected fuel amount) is increased as the pressure of fuel supplied to the injector 9 is increased. Thus, in the present embodiment, the pressure of fuel supplied to the injector 9 is controlled in order to control the injected fuel amount. Thus, an injection pressure sensor 13 for measuring the pressure of fuel supplied to the injector 9 is disposed in the injector 9.

A relief valve (not illustrated) that is opened when the pressure of fuel is excessively high is disposed in the injector 9. Fuel that is discharged from the injector 9 through the relief valve returns to the fuel tank 1 through the relief channel 11.

The electronic control unit 20 is configured with a digital computer and includes a ROM 22, a RAM 23, a CPU 24, an input port 25, and an output port 26 that are connected to each other by a bidirectional bus 21.

Analog signals from the common rail pressure sensor 12, the injection pressure sensor 13, the pressurization device temperature sensor 14, and the like are converted into digital signals through corresponding AD converters 27, and the digital signals are input into the input port 25. An analog signal from an accelerator pedal stepping amount sensor 15 is converted into a digital signal through the AD converter 27, and the digital signal is input into the input port 25. The accelerator pedal stepping amount sensor 15 detects the amount of stepping on an accelerator pedal in order to detect load of the internal combustion engine 100. A digital signal that is output from a crank angle sensor 16 for detecting the rotational speed of a crankshaft is input into the input port 25. Accordingly, output signals of various sensors needed for controlling the internal combustion engine 100 are input into the input port 25. The output port 26 is connected to the supply pump 3, the pressurization device 7, the injector 9, and the like. The output port 26 outputs a digital signal calculated by the CPU 24.

Figure 2A:
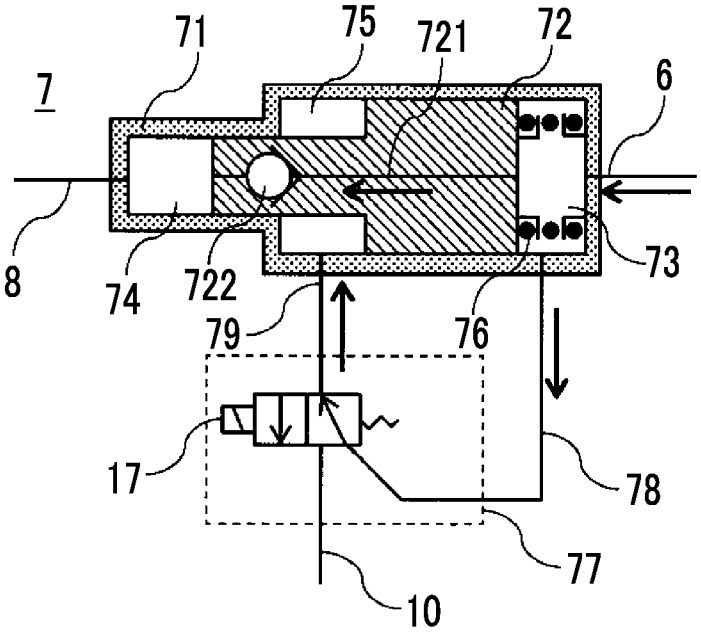
FIG. 2A is a schematic diagram illustrating a state of a pressurization device in which fuel is retained in a pressurization chamber.
Figure 2B:
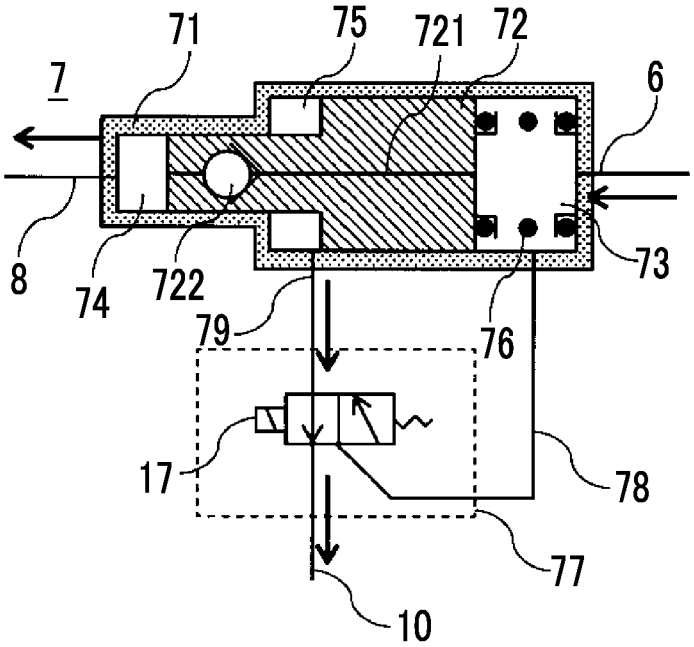
FIG. 2B is a schematic diagram illustrating a state of the pressurization device in which fuel in the pressurization chamber is discharged.

Next, a configuration of the pressurization device 7 will be described with reference to FIG. 2A and FIG. 2B. FIG. 2A is a schematic diagram illustrating the state of the pressurization device 7 before fuel is pressurized by the pressurization device 7. FIG. 2B is a schematic diagram illustrating a state in which the pressurization device 7 pressurizes and discharges fuel toward the injector 9.

As illustrated in FIG. 2A, the pressurization device 7 includes a housing 71, a piston 72, a piston chamber 73, a pressurization chamber 74, a pressurization control chamber 75, a spring 76, a three-way valve 77, a first three-way valve channel 78, and a second three-way valve channel 79. Arrows in FIG. 2A and FIG. 2B indicate the direction in which fuel flows.

The inside of the housing 71 is filled with fuel. In the present embodiment, a first end (right side in FIG. 2A and FIG. 2B) in the longitudinal direction of the housing 71 is connected to the supply channel 6, and a second end (left side in FIG. 2A and FIG. 2B) in the longitudinal direction of the housing 71 is connected to the injection channel 8. Fuel that is supplied into the housing 71 through the supply channel 6 is discharged from the injection channel 8. In the following description, the right side in FIG. 2A and FIG. 2B will be referred to as a supply channel 6 side, and the left side in FIG. 2A and FIG. 2B will be referred to as an injection channel 8 side.

The housing 71 has a shape in which two cylinders having different inner diameters are connected to each other. The inner diameter of the cylinder on the supply channel 6 side is larger than the inner diameter of the cylinder on the injection channel 8 side. Hereinafter, the cylinder on the supply channel 6 side will be referred to as a "large diameter portion of the housing 71". An inner circumferential surface of the large diameter portion of the housing 71 will be referred to as a "large diameter inner circumferential surface of the housing 71". The cylinder on the injection channel 8 side will be referred to as a "small diameter portion of the housing 71". An inner circumferential surface of the small diameter portion of the housing 71 will be referred to as a "small diameter inner circumferential surface of the housing 71".

The housing 71 accommodates the piston 72 such that the piston 72 can move inside the housing 71 in the longitudinal direction of the housing 71.

The piston 72 has a shape in which two circular columns having different diameters are connected to each other. The diameter on the supply channel 6 side is larger than the diameter on the injection channel 8 side. Hereinafter, the circular column on the supply channel 6 side will be referred to as a large diameter portion of the piston 72. An outer circumferential surface of the large diameter portion of the piston 72 will be referred to as a large diameter outer circumferential surface of the piston 72. The circular column on the injection channel 8 side will be referred to as a small diameter portion of the piston 72. An outer circumferential surface of the small diameter portion of the piston 72 will be referred to as a small diameter outer circumferential surface of the piston 72.

The piston 72 and the housing 71 divide the inside of the housing 71 into the piston chamber 73 disposed furthest on the supply channel 6 side, the pressurization chamber 74 disposed furthest on the injection channel 8 side, and the pressurization control chamber 75 disposed between the piston chamber 73 and the pressurization chamber 74.

The piston 72 includes an in-piston channel 721 and a non-return valve 722 disposed in the in-piston channel 721. The in-piston channel 721 is disposed to pass through the piston 72 in the longitudinal direction of the piston 72. The non-return valve 722 allows fuel to flow into the in-piston channel 721 toward the pressurization chamber 74 from the piston chamber 73, and restricts fuel flowing into the in-piston channel 721 toward the piston chamber 73 from the pressurization chamber 74.

The piston chamber 73 is a space divided by the end surface of the large diameter portion of the housing 71, the large diameter inner circumferential surface of the housing 71, and the end surface of the large diameter portion of the piston 72. The piston chamber 73 is connected to the supply channel 6. The piston chamber 73 is filled with high pressure fuel supplied from the common rail 5 through the supply channel 6. The spring 76 that extends and contracts in the longitudinal direction of the housing 71 is disposed in the piston chamber 73. The spring 76 pulls the piston 72 to the supply channel 6 side.

The pressurization chamber 74 is a space divided by the small diameter inner circumferential surface of the housing 71, the end surface of the housing on the injection channel 8 side, and the end surface of the piston 72 on the injection channel side. The pressurization chamber 74 is connected to the piston chamber 73 through the in-piston channel 721, and fuel in the piston chamber 73 is supplied to the pressurization chamber 74. The pressurization chamber 74 is also connected to the injection channel 8.

The pressurization control chamber 75 is disposed between the piston chamber 73 and the pressurization chamber 74, and is a space divided by the large diameter inner circumferential surface of the housing 71 and the small diameter outer circumferential surface of the piston 72. In the present embodiment, the pressurization control chamber 75 is connected to the common rail 5 through the second three-way valve channel 79, the first three-way valve channel 78, the piston chamber 73, and the supply channel 6, and is connected to the fuel tank 1 through the second three-way valve channel 79 and the return channel 10.

The pressurization control chamber 75 is selectively connected to the common rail 5 or the fuel tank 1. The pressurization control chamber 75 and the common rail 5 do not have to be directly connected to each other. The connection between the pressurization control chamber 75 and the common rail 5 is defined by formation of a state in which fuel in the common rail 5 is supplied to the pressurization control chamber 75. The same applies to the connection between the pressurization control chamber 75 and the fuel tank 1.

When the pressurization control chamber 75 is connected to the common rail 5, high pressure fuel is supplied into the pressurization control chamber 75. When the pressurization control chamber 75 is connected to the fuel tank 1, fuel inside the pressurization control chamber 75 is discharged, and the fuel pressure inside the pressurization control chamber 75 is decreased.

The three-way valve 77 is a spool solenoid valve in the present embodiment. By the actuator 17 disposed in the three-way valve 77, the three-way valve 77 is driven to switch the pressurization device 7 between a state in which the pressurization control chamber 75 is connected to the common rail 5 (FIG. 2A), and a state in which the pressurization control chamber 75 is connected to the fuel tank 1 (FIG. 2B). The actuator 17 is controlled by a signal output from the electronic control unit 20.

Figure 3:
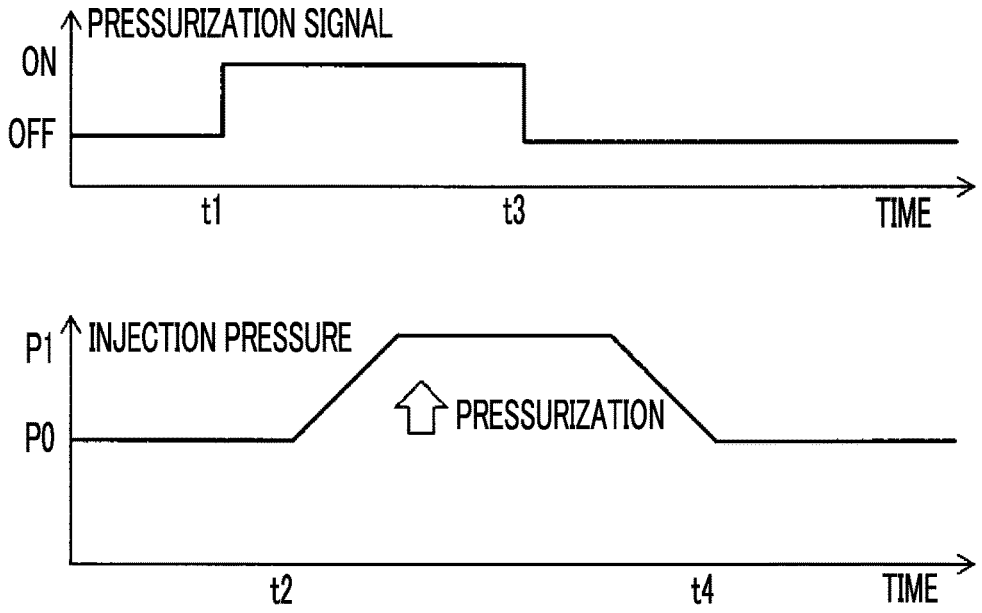
FIG. 3 is a timing chart illustrating a state in which the pressurization device is driven.

Next, operation of the pressurization device 7 will be described with reference to FIG. 2A, FIG. 2B, and FIG. 3. FIG. 3 is a timing chart illustrating a state in which the pressurization device 7 is driven, and illustrates operation of the pressurization device 7 from discharging fuel from the pressurization chamber 74 until returning to the state before discharging fuel.

First, in an initial state (state before time t1), the three-way valve 77 connects the common rail 5 with the pressurization control chamber 75 as in FIG. 2A. In such a case, high pressure fuel is supplied to the piston chamber 73 and the pressurization control chamber 75 from the common rail 5. Thus, the fuel pressure in the piston chamber 73 is balanced with the fuel pressure in the pressurization control chamber 75. Since the spring 76 disposed in the piston chamber 73 pulls the piston 72 to the supply channel 6 side, the piston 72 is positioned on the supply channel 6 side.

At time t1, the electronic control unit 20 switches a pressurization signal from OFF to ON to drive the actuator 17. The pressurization signal is a signal for driving the pressurization device 7. Consequently, the pressurization control chamber 75 is connected to the fuel tank 1 through the return channel 10. That is, the three-way valve 77 is disposed as in FIG. 2B. In such a case, fuel in the pressurization control chamber 75 is discharged to the fuel tank 1, and the fuel pressure in the pressurization control chamber 75 is decreased. Consequently, the pressure of the piston chamber 73 becomes higher than the pressure of the pressurization control chamber 75, and fuel filling the piston chamber 73 starts to exert force in a direction of pushing the piston 72 to the injection channel 8 side. The piston 72 does not move at time t1. Thus, at time t1, the piston 72 is in a position as in FIG. 2A, and the three-way valve 77 is in a position as in FIG. 2B.

At time t2, when the piston 72 starts to move to the injection channel 8 side as illustrated in FIG. 2B, the volume of the pressurization chamber 74 is reduced. Accordingly, fuel filling the pressurization chamber 74 is discharged to the injection channel 8. A sectional area S0 of the large diameter portion of the piston 72 is larger than a sectional area S1 of the small diameter portion of the piston 72. Thus, by Pascal's principle, a fuel pressure P1 of the pressurization chamber 74 is increased by S0/S1 of a fuel pressure P0 of the piston chamber 73. In the following description, the fuel pressure ratio S0/S1 will be referred to as a pressurization ratio $\alpha$. For example, the pressurization ratio $\alpha$ is two in the present embodiment. Since the non-return valve 722 is disposed in the in-piston channel 721, fuel barely flows back to the piston chamber 73 even with the reduction in the pressurization chamber 74.

At time t3, the electronic control unit 20 switches the pressurization signal from ON to OFF to drive the actuator 17. Consequently, the pressurization control chamber 75 is connected to the common rail 5 through the piston chamber 73. That is, the three-way valve 77 is disposed as in FIG. 2A. In such a case, high pressure fuel is again supplied to the pressurization control chamber 75 from the common rail 5, and the fuel pressure in the pressurization control chamber 75 is increased. Consequently, the force of the piston 72 pushing fuel within the pressurization chamber 74 is reduced, and the pressure of fuel discharged from the pressurization chamber 74 is gradually decreased with elapse of time.

At time t4 after elapse of time, the movement of the piston 72 to the injection channel 8 side is finished, and the pressure of fuel discharged from the pressurization chamber 74 is equal to the pressure of fuel supplied to the common rail 5.

When time further elapses, the spring 76 disposed in the piston chamber 73 pulls the piston 72 to the supply channel 6 side. Thus, the piston 72 is moved to the supply channel 6 side and finally returns to the state in FIG. 2A.

While the piston 72 moves to the supply channel 6 side, the capacity of the pressurization chamber 74 is increased, and fuel is supplied to the pressurization chamber 74 from the piston chamber 73 through the in-piston channel 721.

As described heretofore, the pressure of, injected fuel can be increased by driving the pressurization device 7, that is, causing the piston 72 to reciprocate, each time a fuel injection timing arrives.

Figure 4:
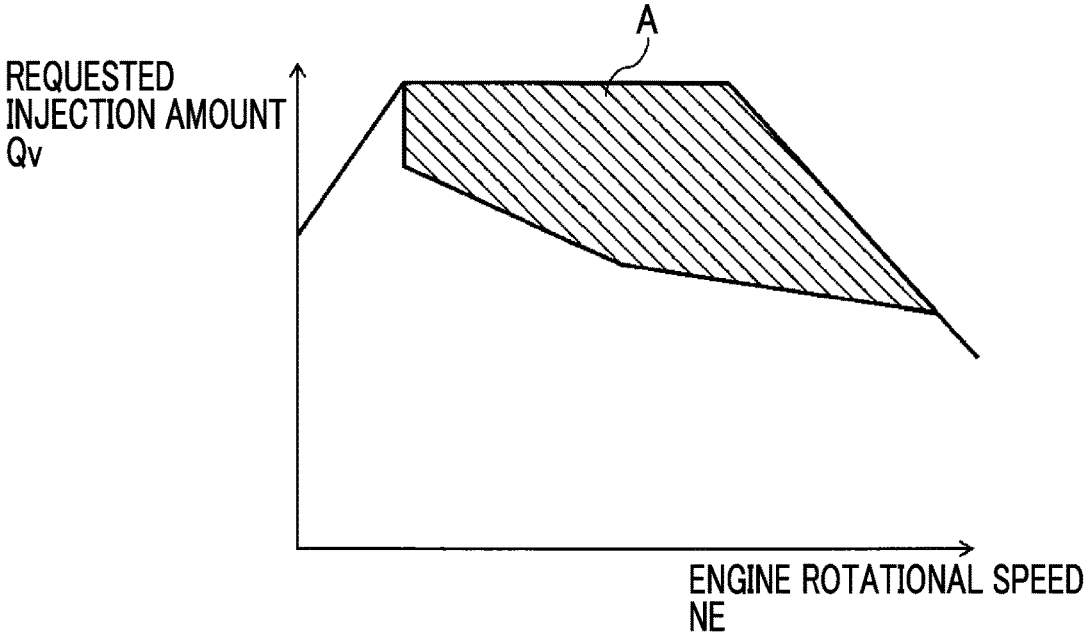
FIG. 4 is a map for determining need for driving the pressurization device.

The pressurization device 7 is generally used when it is desirable to increase the pressure of injected fuel. More specifically, when a requested injection amount Qv is large, and it is desirable to increase the amount of injected fuel, or when an engine rotational speed NE is large, and it is desirable to supply fuel in a short time period, the pressurization device 7 is driven in order to increase the pressure of injected fuel. FIG. 4 is a map for determining whether or not to drive the pressurization device 7 for pressurization. In the present embodiment, the electronic control unit 20 determines whether or not to drive the pressurization device 7 by referencing the map in FIG. 4. The map has a horizontal axis as the engine rotational speed NE acquired from the crank angle sensor 16 and a vertical axis as the requested injection amount Qv acquired from the accelerator pedal stepping amount sensor 15. When NE and Qv are within an operating region (A) set in advance, the electronic control unit 20 drives the pressurization device 7.

When the electronic control unit 20 drives the pressurization device 7, the piston 72 moves to the injection channel 8 side. Thus, high pressure fuel filling the pressurization control chamber 75 is discharged to the fuel tank 1 through the return channel 10. Since the pressure of fuel discharged from the pressurization control chamber 75 is decreased, energy that is retained as pressure is converted into thermal energy. The temperature of fuel flowing in the return channel 10 is related to the fuel pressure in the pressurization control chamber 75 before the pressurization device 7 is driven. As described above, since fuel is supplied to the pressurization control chamber 75 from the common rail 5 through the piston chamber 73, the temperature of fuel flowing in the return channel 10 is related to the common rail pressure.

Figure 5:
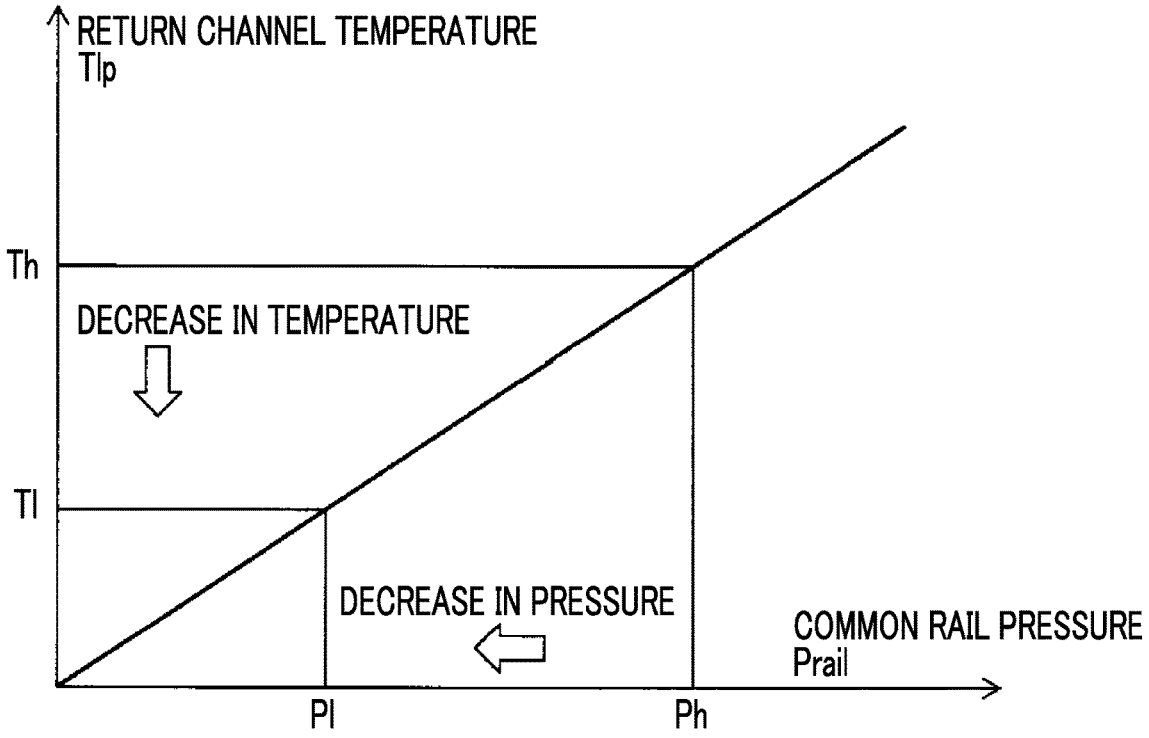
FIG. 5 is a graph illustrating a relationship between a common rail pressure and a return channel temperature.

FIG. 5 is a graph illustrating a relationship between a common rail pressure Prail and a return channel temperature Tlp. For example, it is assumed that the temperature of fuel flowing in the return channel 10 is Th when the common rail pressure Prail is Ph. Next, when the common rail pressure Prail is P1 that is lower than Ph, the temperature Tlp of fuel flowing in the return channel 10 is Tl that is lower than Th. That is, when the common rail pressure Prail is high, fuel having a high pressure corresponding to the high common rail pressure Prail is supplied, to the pressurization control chamber 75. When fuel is discharged to the return channel 10 from the pressurization control chamber 75, there is a large decrease in the pressure of discharged fuel, and large thermal energy corresponding to the large decrease is discharged. When the common rail pressure Prail is low, the pressure of fuel supplied to the pressurization control chamber 75 is also low. Thus, when fuel is discharged to the return channel 10 from the pressurization control chamber 75, there is a small decrease in the pressure of fuel, and discharge of thermal energy is reduced.

When the set of the engine rotational speed NE and the requested injection amount Qv is within the operating region (A), the requested injection amount Qv is large, and the common rail pressure is comparatively high. Accordingly, when the pressurization device 7 is driven in the operating region (A), the temperature of fuel in the return channel 10 is increased. For example, when the state in which the set of the engine rotational speed NE and the requested injection amount Qv is within the operating region (A) continues for a long time period, the pressurization device 7 remains at a high temperature. Thus, the actuator 17 of the pressurization device 7 may be thermally damaged, and the durability of the pressurization device 7 may be decreased.

In the present embodiment, the return channel 10 and the actuator 17 are cooled by using the fact that the temperature Tlp of fuel flowing in the return channel 10 is low when the common rail pressure Prail is low as described above. That is, the pressurization device 7 is driven when the common rail pressure Prail is set such that the temperature Tlp of fuel flowing in the return channel 10 is lower than a temperature Tm of the pressurization device 7 acquired from the pressurization device temperature sensor 14 disposed in the pressurization device 7. Consequently, fuel having a lower temperature than the temperature Tm of the pressurization device 7 flows in the return channel 10, and the return channel 10 and the actuator 17 are cooled.

Figure 6:
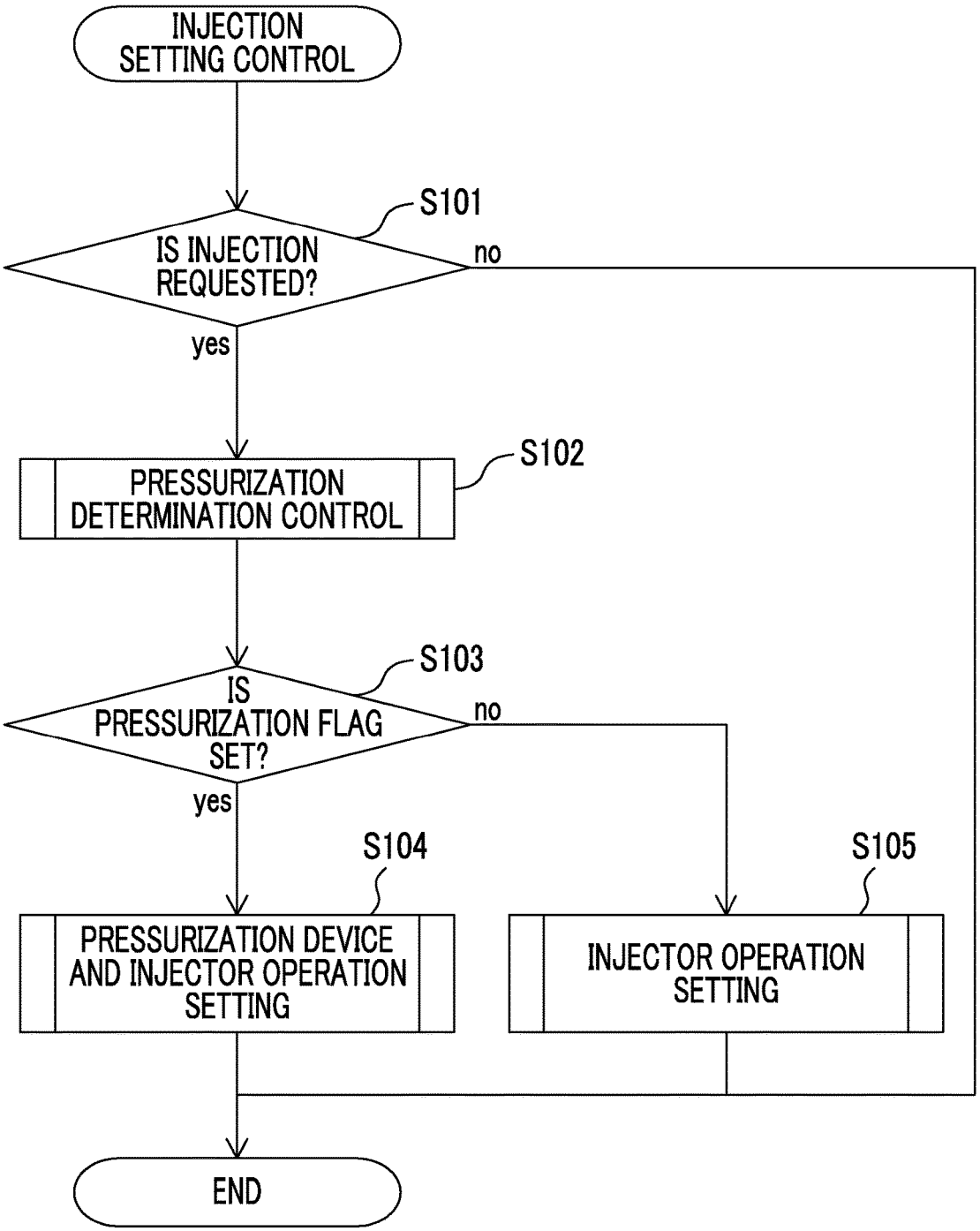
FIG. 6 is a flowchart illustrating a routine for setting a fuel injection operation in a first embodiment of the present disclosure.

Next, injection setting control in the first embodiment will be described. FIG. 6 illustrates a routine for setting a fuel injection operation in the first embodiment. The routine is executed, by an interruption per certain time period. The routine sets the subsequent operation of the pressurization device 7 and the injector 9. That is, even when the routine is executed during operation of the pressurization device 7 and the injector 9, the operation of the pressurization device 7 and the injector 9 is not affected immediately, and the subsequent operation of the pressurization device 7 and the injector 9 is set.

In step S101, the electronic control unit 20 determines whether or not fuel injection is needed. When the electronic control unit 20 determines that the internal combustion engine 100 needs to generate torque, based on input from the accelerator pedal stepping amount sensor 15, the electronic control unit 20 determines that fuel injection is needed, and that injection is requested. When the engine rotational speed NE acquired from the crank angle sensor 16 is decreased at the time of a stoppage of a vehicle, the electronic control unit 20 may determine that fuel injection is needed in order to keep the internal combustion engine 100 operating. When a determination that fuel injection is needed is made in stop S101, that is, when injection is requested, a transition is made to step S102. When a determination that fuel injection is not needed is made in step S101, that is, injection is not requested, the process is finished.

In step S102, the electronic control unit 20 executes pressurization determination control for determining whether or not to drive the pressurization device 7 and sets a pressurization flag for storing whether or not to drive the pressurization device 7 or resets the pressurization flag. The pressurization flag is set in the initial state. The pressurization determination control will be described in detail below by using FIG. 7. In step S102, when the electronic control unit 20 determines that the pressurization device 7 needs to be driven, the pressurization flag is set. When the electronic control unit 20 determines that the pressurization device 7 does not have to be driven, the pressurization flag is reset. When the process of step S102 is finished, a transition is made to step S103.

In step S103, the electronic control unit 20 determines whether or not the pressurization flag is set. When the pressurization flag is set, a transition is made to step S104. When the pressurization flag is reset, a transition is made to step S105.

In step S104, the electronic control unit 20 sets the operation of the pressurization device 7 and the injector 9. Specifically, the electronic control unit 20 determines the timing of driving the pressurization device 7 and the timing of driving the injector 9, and adjusts the timings of driving the pressurization device 7 and the injector 9 in accordance with the time of fuel injection such that fuel is pressurized. When the process of step S104 is finished, the present routine is finished.

In step S105, the electronic control unit 20 sets the operation of the injector 9, in such a case, the electronic control unit 20 controls the actuator 17 to keep the three-way valve 77 in the state of connecting the pressurization control chamber 75 with the common rail 5 (that is, the state in FIG. 2A). Consequently, fuel supplied to the pressurization device 7 is supplied to the injector 9 without being pressurized. When the process of step S105 is finished, the present routine is finished.

Figure 7:
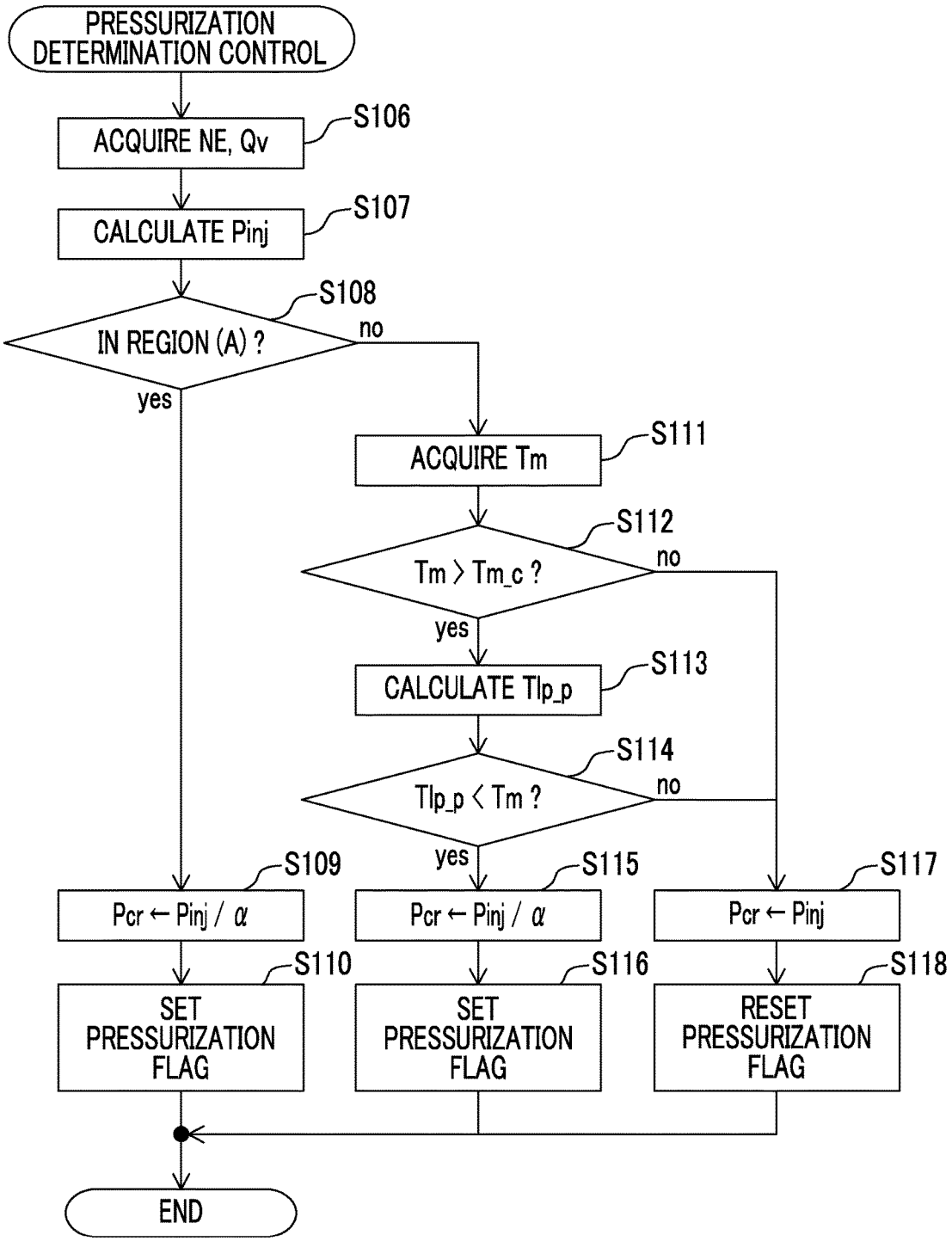
FIG. 7 is a flowchart illustrating a routine for determining whether or not to drive the pressurization device in the first embodiment.

FIG. 7 illustrates a routine of pressurization determination control, that is, a routine for the electronic control unit 20 to determine whether or not to drive the pressurization device 7. The routine is executed by an interruption per certain time period.

In step S106, the electronic control unit 20 calculates the engine rotational speed NE based on an output value of the crank angle sensor 16, and calculates the requested injection amount Qv based on an output value of the accelerator pedal stepping amount sensor 15.

In step S107, the electronic control unit 20 calculates a target pressure (hereinafter, referred to as a "target injection fuel pressure") Pinj of fuel supplied to the injector 9. In the present embodiment, the target injection fuel pressure Pinj is acquired from the map of the engine rotational speed NE and the requested injection amount Qv.

In step S108, the electronic control unit 20 determines whether or not the engine rotational speed NE and the requested injection amount Qv are included in the operating region (A) in FIG. 4, in order to determine whether or not to drive the pressurization device 7. When the engine rotational speed NE and the requested injection amount Qv are within the operating region (A) in FIG. 4, the electronic control unit 20 determines that the pressurization device 7 needs to be driven, and transitions to step S109. When the engine rotational speed NE and the requested injection amount Qv are not within the operating region (A) in FIG. 4, the electronic control unit 20 transitions to step S111.

In step S109, the electronic control unit 20 sets a target pressure (hereinafter, referred to as a "target common rail pressure") Pcr of the common rail 5. Specifically, when the pressurization ratio of the pressurization device 7 is $\alpha$, the electronic control unit 20 sets the target common rail pressure Pcr to Pinj/$\alpha$. When the target common rail pressure Pcr is Pinj/$\alpha$, the pressure of injected fuel supplied to the injector 9 becomes equal to the injection fuel pressure Pinj after pressurization by the pressurization device 7.

In step S110, the electronic control unit 20 sets the pressurization flag that is set when the pressurization device 7 is driven, and finishes the process of the present routine. In conclusion, step S110 is executed when the pressurization device 7 needs to be driven because the engine rotational speed NE and the requested injection amount Qv are large. In such a case, the electronic control unit 20 controls the actuator 17 to drive the pressurization device 7.

For example, it is assumed that the target injection fuel pressure is 300 MPa in the operating region (A). Since the pressurization ratio is two in the present embodiment, the target common rail pressure at the time of assuming that the pressurization device 7 is driven is 150 MPa. When it is assumed that the temperature of the return channel 10 is 200° C. at the target common rail pressure, the temperature of the pressurization device 7 is increased to 200° C. by continuously driving the pressurization device 7 in the operating region (A).

Returning to step S108, a case in which the engine rotational speed NE and the requested injection amount Qv are not included in the operating region (A) in FIG. 4 will be described.

In step S111, the electronic control unit 20 reads the temperature Tm of the pressurization device 7 measured by the pressurization device temperature sensor 14.

In step S112, the electronic control unit 20 determines whether or not the pressurization device 7 needs to be cooled. Specifically, the electronic control unit 20 compares the temperature Tm of the pressurization device 7 with a predetermined cooling request temperature Tm_c for determining whether or not the pressurization device 7 needs to be cooled. When the temperature Tm of the pressurization device 7 is higher than the predetermined cooling request temperature Tm_c, the electronic control unit 20 determines that the pressurization device 7 needs to be cooled, and transitions to a process of step S113 When the temperature Tm of the pressurization device 7 is lower than or equal to the predetermined cooling request temperature Tm_c, the electronic control unit 20 transitions to a process of step S117.

The predetermined cooling request temperature Tm_c is set in advance as a value such that the pressurization device 7 may be thermally damaged when the pressurization device 7 remains at a temperature higher than or equal to the predetermined cooling request temperature Tm_c. The predetermined cooling request temperature Tm_c is, for example, 150° C.

In step S113, the electronic control unit 20 calculates an estimated return channel temperature Tlp_p that is the temperature of fuel flowing in the return channel 10 at the time of assuming that the pressurization device 7 is driven. The estimated return channel temperature Tlp_p is used for determining whether or not to drive the pressurization device 7 for cooling. Thus, the actual estimated return channel temperature Tlp_p cannot be measured by driving the pressurization device 7. Accordingly, in step S113, the electronic control unit 20 estimates the estimated return channel temperature Tlp_p by assuming that the pressurization device 7 is driven.

Specifically, the electronic control unit 20 first calculates the target common rail pressure Pcr at the time of assuming that the pressurization device 7 is driven. In the present embodiment, the target common rail pressure Pcr is Pinj/$\alpha$. From the acquired target common rail pressure Pcr, the electronic control unit 20 acquires the estimated retain channel, temperature Tlp_p at the time of assuming that the pressurization device 7 is driven, by using the relationship between the common rail pressure and the return channel temperature as in FIG. 5.

In step S114, the electronic control unit 20 determines whether or not the pressurization device 7 can be cooled by driving the pressurization device 7. Specifically, the electronic control unit 20 compares the temperature Tm of the pressurization device 7 with the estimated return channel temperature Tlp_p acquired in step S113. When the estimated return channel temperature Tlp_p is lower than the temperature Tm of the pressurization device 7, the electronic control unit 20 determines that the pressurization device 7 can be cooled by driving the pressurization device 7, and transitions to a process of step S115. When the estimated return channel temperature Tlp_p is higher than or equal to the temperature Tm of the pressurization device 7, the electronic control unit 20 determines that the pressurization device 7 is further heated by driving the pressurization device 7, and transitions to the process of step S117.

In step S115, the electronic control unit 20 sets the target common rail pressure Pcr to Pinj/$\alpha$. When the target common rail pressure Pcr is Pinj/a, the pressure of injected fuel supplied to the injector 9 becomes equal to the injection fuel pressure Pinj after pressurization by the pressurization device 7.

In step S116, the electronic control unit 20 sets the pressurization flag that is set when the pressurization device 7 is driven, and finishes the process of the present routine.

In conclusion, when the temperature of the pressurization device 7 is high, and it is expected that the pressurization device 7 is not heated even when the pressurization device 7 is driven, step S116 is executed. In such a case, the electronic control unit 20 sets driving of the pressurization device 7 in order to cool the pressurization device 7.

For example, it is assumed that the electronic control unit 20 sets the target injection fuel pressure Pinj to 100 MPa when the temperature Tm of the pressurization device 7 is 160° C. and exceeds the predetermined cooling request temperature Tm_c of 150° C. In such a case, when it is assumed that the electronic control unit 20 drives the pressurization device 7, the target common rail pressure Pcr is 50 MPa. When it is assumed that the estimated return channel temperature Tlp_p is 100° C. at the target common rail pressure, the electronic control unit 20 continues driving the pressurization device 7 in the operating region (A) and decreases the temperature Tm of the pressurization device 7 to 100° C.

Returning to step S112, when the temperature Tm of the pressurization device 7 is lower than or equal to the predetermined cooling request temperature Tm_c, the electronic control unit 20 determines that the pressurization device 7 does not have to be cooled, and executes the process of step S117.

Returning to step s114, when the estimated return channel temperature Tlp_p is higher than or equal to the temperature Tm of the pressurization device 7, the electronic control unit 20 determines that the pressurization device 7 cannot be cooled even when the pressurization device 7 is driven, and executes the process of step S117.

In step S117, the electronic control unit 20 sets the target common rail pressure Pcr to a pressure equal to the target injection pressure Pinj. Accordingly, when the electronic control unit 20 sets the target common rail pressure Pcr, the electronic control unit 20 supplies fuel having the target injection pressure Pinj to the injector 9 without driving the pressurization device 7. Next, a transition is made to step S118.

In step S118, the electronic control unit 20 resets the pressurization flag that is set when the pressurization device 7 is driven, and finishes the process of the present routine.

In conclusion, when the process transitions to step S117 from step S112, the electronic control unit 20 determines that the pressurization device 7 does not have to be cooled, and does not drive the pressurization device 7.

For example, it is assumed that the electronic control unit 20 sets the target injection fuel pressure Pinj to 100 MPa when the temperature Tm of the pressurization device 7 is 120° C. and is lower than or equal to the predetermined cooling request temperature Tm_c of 150° C. In such a case, the electronic control unit 20 sets the target common rail pressure Pcr to 100 MPa.

When the process transitions to step S117 from step S114, the electronic control unit 20 determines that the pressurization device 7 cannot be cooled, and does not drive the pressurization device 7.

For example, it is assumed that the temperature Tm of the pressurization device 7 is 160° C., and that the target injection fuel pressure Pinj is 240 MPa. In such a case, the target common rail pressure Pcr in the case of driving the pressurization device 7 is 120 MPa. When it is assumed that the estimated return channel temperature Tlp_p at such time is 170° C., the electronic control unit 20 sets the target common rail pressure to 240 MPa without driving the pressurization device 7, since the estimated return channel temperature is higher than the temperature of the pressurization device 7. When fuel is injected after the electronic control unit 20 sets the target common rail pressure Pcr and sets whether or not to drive the pressurization device 7, the electronic control unit 20 controls the supply pump 3 such that the common rail pressure becomes equal to the target common rail pressure Pcr. The electronic control unit 20 also controls the actuator 17 to control driving of the pressurization device 7.

As described heretofore, according to the first embodiment, the internal combustion engine 100 includes the fuel tank 1, the supply pump 3 for increasing the fuel pressure in the fuel tank 1, the common rail 5 (high pressure fuel channel) in which fuel increased in pressure by the supply pump 3 flows, and the pressurization device 7 for increasing the pressure of fuel supplied from the common rail 5 (high pressure fuel channel). The internal combustion engine 100 further includes the return channel 10 (low pressure fuel channel) in which fuel returning to the fuel tank 1 from the pressurization device 7 without pressurization by the pressurization device 7 flows, and the injector 9 (fuel injection device) for injecting fuel increased in pressure by the pressurization device 7.

The pressurization device 7 disposed in the internal combustion engine 100 includes the housing 71 having a cylindrical shape, and the piston 72 reciprocatingly movably accommodated within the housing 71. The pressurization device 7 includes the pressurization chamber 74 that is formed by being surrounded by a first end of the piston 72 and the housing 71. The pressurization chamber 74 is filled with fuel that is discharged toward the injector 9 (fuel injection device) by increasing the pressure of fuel. The pressurization device 7 includes the piston chamber 73 that is formed by being surrounded by a second end of the piston 72 and the housing 71. In the piston chamber 73, the pressure of fuel supplied from the common rail 5 (high pressure fuel channel) pushes the piston 72 and pressurizes fuel within the pressurization chamber 74. The pressurization device 7 includes the pressurization control chamber 75 that is formed by being surrounded by the piston 72 and the housing 71, and is disposed between the pressurization chamber 74 and the piston chamber 73. In the pressurization control chamber 75, fuel that fills the pressurization control chamber 75 from the common rail 5 (high pressure fuel channel) is discharged to the return channel 10 (low pressure fuel channel) during pressurization of fuel in the pressurization chamber 74. The pressurization device 7 includes the three-way valve 77 (switching device) that selectively connects the pressurization control chamber 75 with the common rail 5 (high pressure fuel channel) or the return channel 10 (low pressure fuel channel).

The electronic control unit 20 (control device) for the internal combustion engine 100 estimates the temperature Tlp_p of the return channel 10 (low pressure fuel channel), assuming that the pressurization control chamber 75 and the return channel 10 (low pressure fuel channel) are connected to each other. When the temperature Tlp_p of the return channel 10 (low pressure fuel channel) estimated by the electronic control unit 20 (control device) is lower than the temperature Tm of the pressurization device 7, and the temperature Tm of the pressurization device 7 is higher than the predetermined cooling request temperature Tm_c, the electronic control unit 20 controls the three-way valve 77 (switching device) to connect the pressurization control chamber 75 with the return channel 10 (low pressure fuel channel).

When the temperature Tm of the pressurization device 7 is higher than the predetermined cooling request temperature Tm_c, cooling is needed. At such time, when the estimated return channel temperature Tlp_p at the time of driving the pressurization device 7 is lower than the temperature Tm of the pressurization device 7, the pressurization device 7 can be cooled by driving the pressurization device 7.

According to the first embodiment, when fuel injection is requested, the electronic control unit 20 (the control device for the internal combustion engine 100) calculates the target injection fuel pressure Pinj that is the target value of the pressure of fuel supplied to the injector 9 (fuel injection device) from the pressurization device 7. Then, based on the target injection fuel pressure Pinj, the electronic control unit 20 calculates the target common rail pressure Pcr (target fuel pressure) that is the target pressure of the common rail 5 (high pressure fuel channel). Next, based on the target common rail pressure Pcr (target fuel pressure), the electronic control unit 20 estimates the estimated return channel temperature Tlp_p (the fuel temperature in the low pressure fuel channel).

According to such an embodiment, even when the target injection fuel pressure Pinj fluctuates, the estimated return channel temperature Tlp_p also fluctuates in accordance with the fluctuation in the target injection fuel pressure Pinj. Thus, the accuracy in estimation of the fuel temperature can be increased.

Second Embodiment

Next, a second embodiment of the present disclosure will be described. The difference between the first embodiment and the second embodiment is the routine for determining whether or not to drive the pressurization device 7. That is, while the first embodiment determines whether or not to drive the pressurization device 7 based on the estimated return channel temperature Tlp_p, the second embodiment determines whether or not to drive the pressurization device 7 for cooling based on a map.

More specifically, the first embodiment measures the temperature of the pressurization device 7 at the timing of determining whether or not to drive the pressurization device 7, and drives the pressurization device based on the temperature of the pressurization device 7. In the second embodiment, the electronic control unit 20 measures the temperature of the pressurization device 7 regardless of the timing of determining whether or not to drive the pressurization device 7, and switches the map for determining whether or not to drive the pressurization device 7 when the temperature of the pressurization device 7 rises. In the second embodiment, the electronic control unit 20 determines whether or not to drive the pressurization device 7 by referencing the switched map, at the timing of determining whether or not to drive the pressurization device 7.

Figure 8:
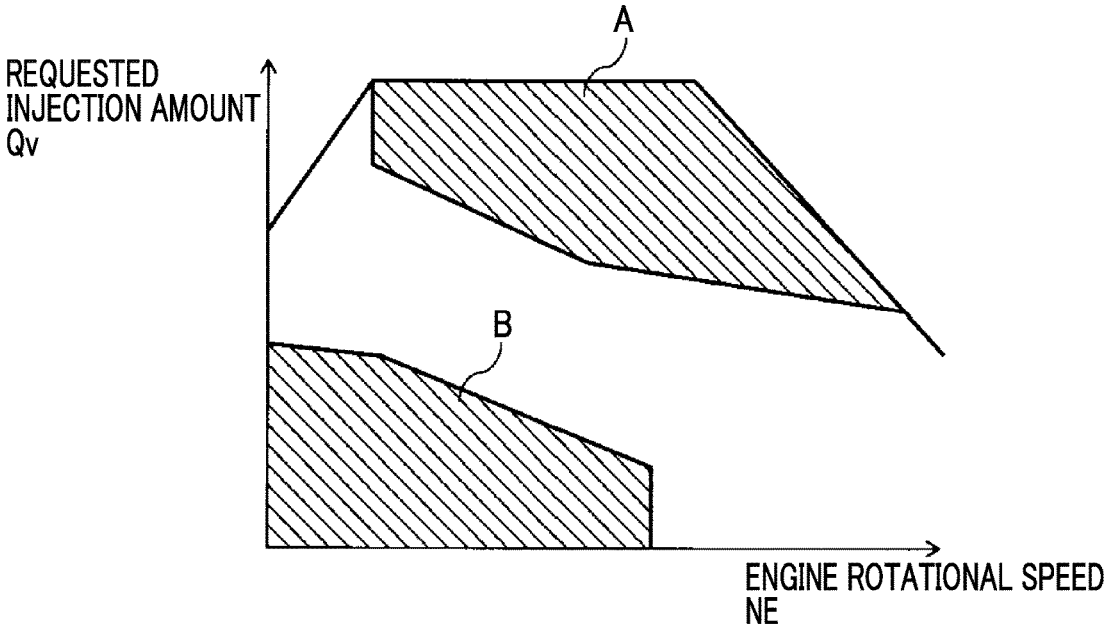
FIG. 8 is a map for determining need for driving the pressurization device in a second embodiment of the present disclosure.

FIG. 8 is a map for determining whether or not to drive the pressurization device 7 based on the engine rotational speed NE and the requested injection amount Qv in the second embodiment. The difference from the map in FIG. 4 is that anew operating region (B) in which the engine rotational speed NE and the requested injection amount Qv are small is set. The electronic control unit 20 drives the pressurization device 7 when the set of the engine rotational speed NE and the requested injection amount Qv is within the range of the operating region (B). The operating region (B) is set such that the estimated return channel temperature Tlp_p at the time of driving the pressurization device 7 for pressurizing fuel is always lower than the predetermined cooling request temperature Tm_c.

In the second embodiment, the electronic control unit 20 stores both of the map in FIG. 8 and the map in FIG. 4. The electronic control unit 20 selects the map in FIG. 8 when the pressurization device 7 needs to be cooled. The electronic control unit 20 selects the map in FIG. 4 when the pressurization device 7 does not have to be cooled.

Next a control flow in the second embodiment will be described. The second embodiment uses three routines of a routine for setting the fuel injection operation (that is, a routine corresponding to FIG. 6 in the first embodiment), a routine for determining whether or not to drive the pressurization device 7 (that is, a routine corresponding to FIG. 7 in the first embodiment), and a routine for switching the map.

Figure 9:
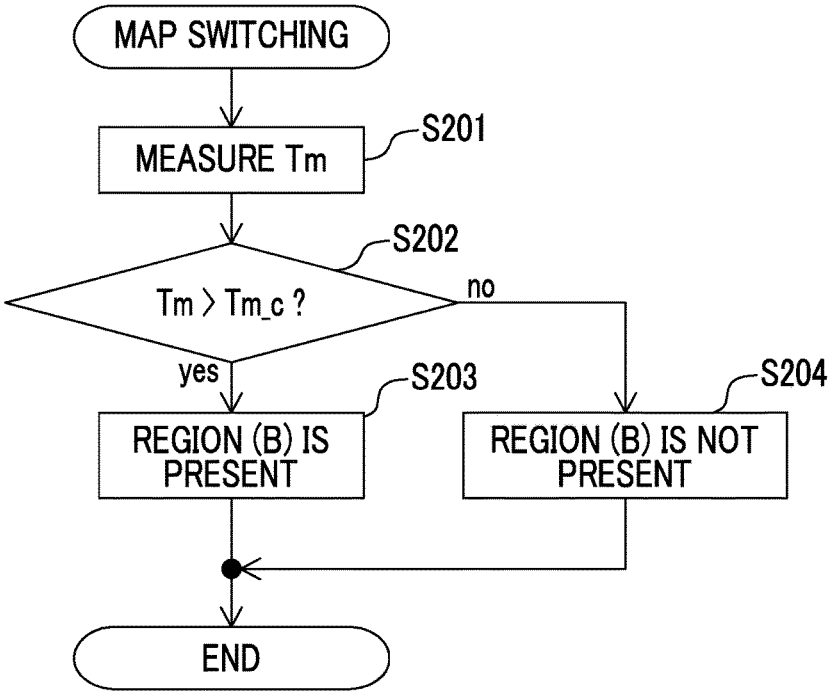
FIG. 9 is a flowchart illustrating a routine for switching the map in the second embodiment.

FIG. 9 illustrates the routine for switching the map in the second embodiment. The routine is executed by an interruption per certain time period.

First, in step S201, the electronic control unit 20 measures the temperature Tm of the pressurization device based on an output value of the pressurization device temperature sensor 14.

In step S202, the electronic control unit 20 compares the temperature Tm of the pressurization device with the predetermined cooling request temperature Tm_c. When the temperature Tm of the pressurization device is higher than the predetermined cooling request temperature Tm_c, the electronic control unit 20 determines that the pressurization device needs to be cooled, and performs a process of step S203. When the temperature Tm of the pressurization device is lower than or equal to the predetermined cooling request temperature Tm_c, the electronic control unit 20 performs a process of step S204.

A case in which the electronic control unit 20 in step S202 determines that the pressurization device 7 needs to be cooled will be described. In such a case, the electronic control unit 20 in step S203 sets the map including the operating region (B), that is, the map in FIG. 8, as the map for determining whether or not to drive the pressurization device 7. In the state in which the map in FIG. 8 is set, when the engine rotational speed NE and the requested injection amount Qv are present in the operating region (B), the electronic control unit 20 drives the pressurization device 7 in order to cool the pressurization device 7. When the process of step S203 is finished, the present routine is finished.

Next, when the electronic control unit 20 in step S202 does not determine that the pressurization device 7 needs to be cooled, the electronic control unit 20 in step S204 sets the map not including the operating region (B), that is, the map in FIG. 4, as the map for determining whether or not the pressurization device 7 needs to be driven. Since the electronic control unit 20 in step S202 does not determine that the pressurization device 7 needs to be cooled, the pressurization device 7 does not have to be driven when the engine rotational speed NE and the requested injection amount Qv are small. Such setting of the map reduces a loss of energy generated by driving the pressurization device 7. When the process of step S204 is finished, the present routine is finished.

Next, the routine for setting the fuel injection operation in the second embodiment uses the same routine as the first embodiment, that is, the routine in FIG. 6, and therefore, will not be described.

Figure 10:
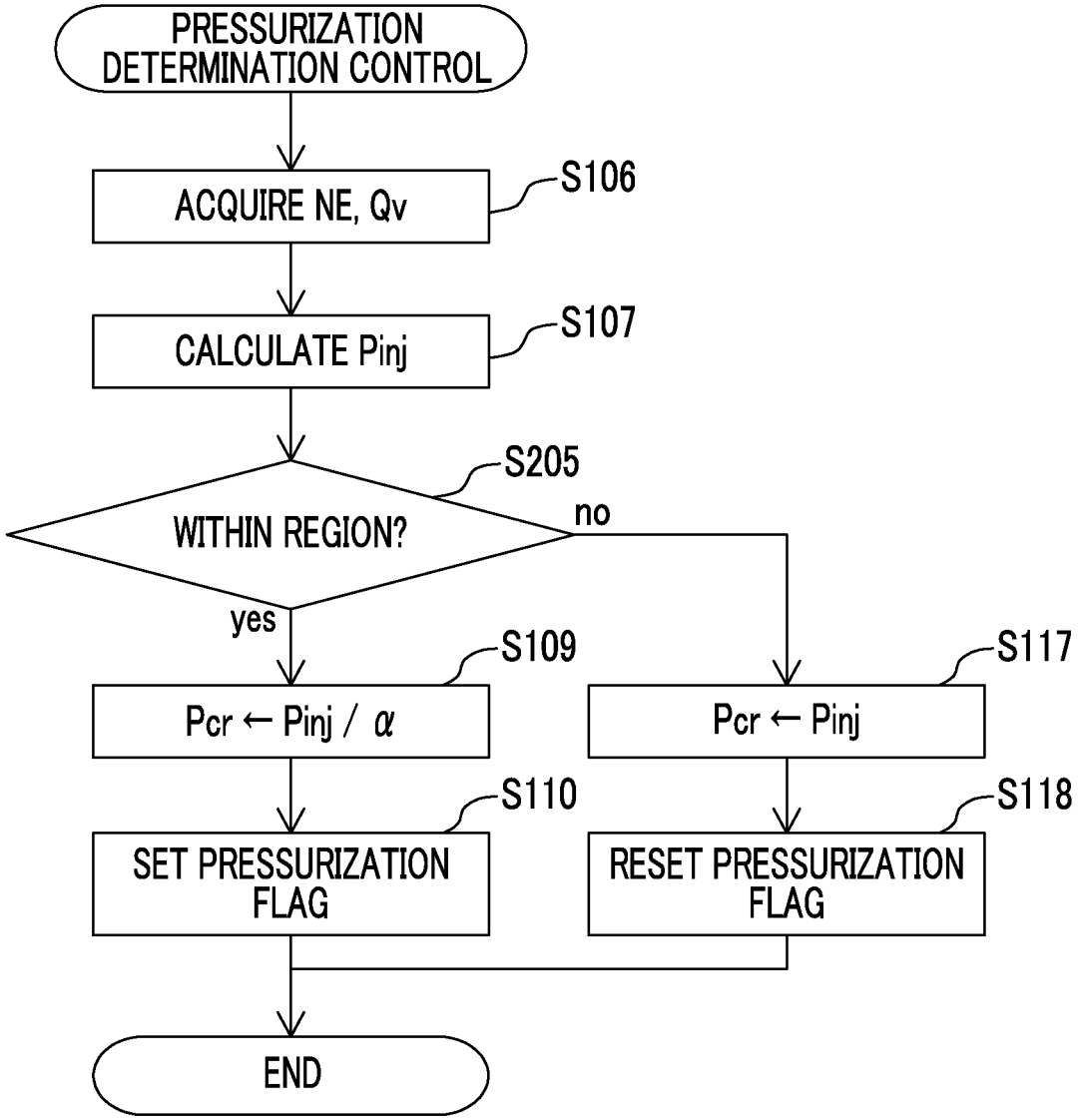
FIG. 10 is a flowchart illustrating a routine of pressurization determination control in the second embodiment.

Lastly, control that determines need for driving the pressurization device 7 in the second embodiment will be described. FIG. 10 is a routine of pressurization determination control in the second embodiment. The routine is executed by an interruption per certain time period.

First, the electronic control unit 20 acquires the engine rotational speed NE and the requested injection amount Qv in step S106 and then, calculates the requested injection pressure Pinj in step S107.

Then, in step S205, the electronic control unit 20 determines whether or not the set of the engine rotational speed NE and the requested injection amount Qv is included in the operating region of the map selected by the map switching control.

In the present step, the electronic control unit 20 determines that pressurization is needed, when the set of the engine rotational speed NE and the requested injection amount Qv is included in either the operating region (A) or the operating region (B). That is, when the set of the engine rotational speed NE and the requested injection amount Qv is included in the operating region (A), the electronic control unit 20 drives the pressurization device 7 in order to increase the injection fuel pressure. When the set of the engine rotational speed NE and the requested injection amount Qv is included in the operating region (B), the electronic control unit 20 drives the pressurization device 7 in order to cool the pressurization device 7.

In the present step, when the set of the engine rotational speed NE and the requested injection amount Qv is included in the operating region (B), a condition that the estimated return channel temperature Tlp_p is lower than the temperature Tm of the pressurization device is satisfied. The reason is because when the pressurization device 7 is driven in the operating region (B), the operating region (B) is set such that the estimated return channel temperature Tlp_p is always lower than the predetermined cooling request temperature Tm_c.

In step S205, when the set of the engine rotational speed NE and the requested injection amount Qv is included in the operating region, the electronic control unit 20 determines that the pressurization device 7 needs to be driven, and performs the process of step S109. When the set of the engine rotational speed NE and the requested injection amount Qv is not included in the operating region, the electronic control unit 20 determines that the pressurization device 7 does not have to be driven, and performs the process of step S117. The control from steps S109 and S117 is the same process as the first embodiment and therefore, will not be described.

As described heretofore, according to the second embodiment, the operating region (B) (first operating region) refers to a region that is configured with the engine rotational speed NE and the target injected fuel amount Qv which cause the return channel temperature Tlp (the fuel temperature in the low pressure fuel channel) to become lower than or equal to the predetermined cooling request temperature Tm_c on the assumption that the pressurization control chamber 75 and the return channel 10 (low pressure fuel channel) are connected to each other. The electronic control unit 20 (the control device for the internal combustion engine 100) stores the map in FIG. 8 (first map) in which the operating region (B) (first operating region) is set, and the map in FIG. 4 (second map) in which the operating region (B) (first operating region) is not set. When the temperature Tm of the pressurization device 7 is higher than the predetermined cooling request temperature Tm_c, the electronic control unit 20 selects the map in FIG. 8 (first map). When the temperature of the pressurization device 7 is lower than or equal to the predetermined cooling request temperature Tm_c, the electronic control unit 20 selects the map in FIG. 4 (second map). In such a state, when the engine rotational speed NE and the target injection amount Qv acquired are included in the operating region (B) (first operating region) of the map selected from the map in FIG. 8 (first map) and the map in FIG. 4 (second map), the electronic control unit 20 connects the pressurization control chamber 75 with the return channel 10 (low pressure fuel channel).

The state in which the engine rotational speed NE and the target injected fuel amount Qv are included in the operating region (B) is a state in which the pressurization device 7 needs to be cooled and can be cooled by driving the pressurization device 7. When the engine rotational speed NE and the target injected fuel amount Qv are included in the operating region (B), the electronic control unit 20 connects the pressurization control chamber 75 with the return channel 10, thereby being capable of cooling the pressurization device 7 by driving the pressurization device 7.

Third Embodiment

Next, a third embodiment of the present disclosure will be described. The difference between the third embodiment and the first embodiment is that the pressurization device 7 is driven in order to cool the pressurization device 7 even when an injection request is not made. Hereinafter, common parts in the first embodiment will not be described.

Figure 11:
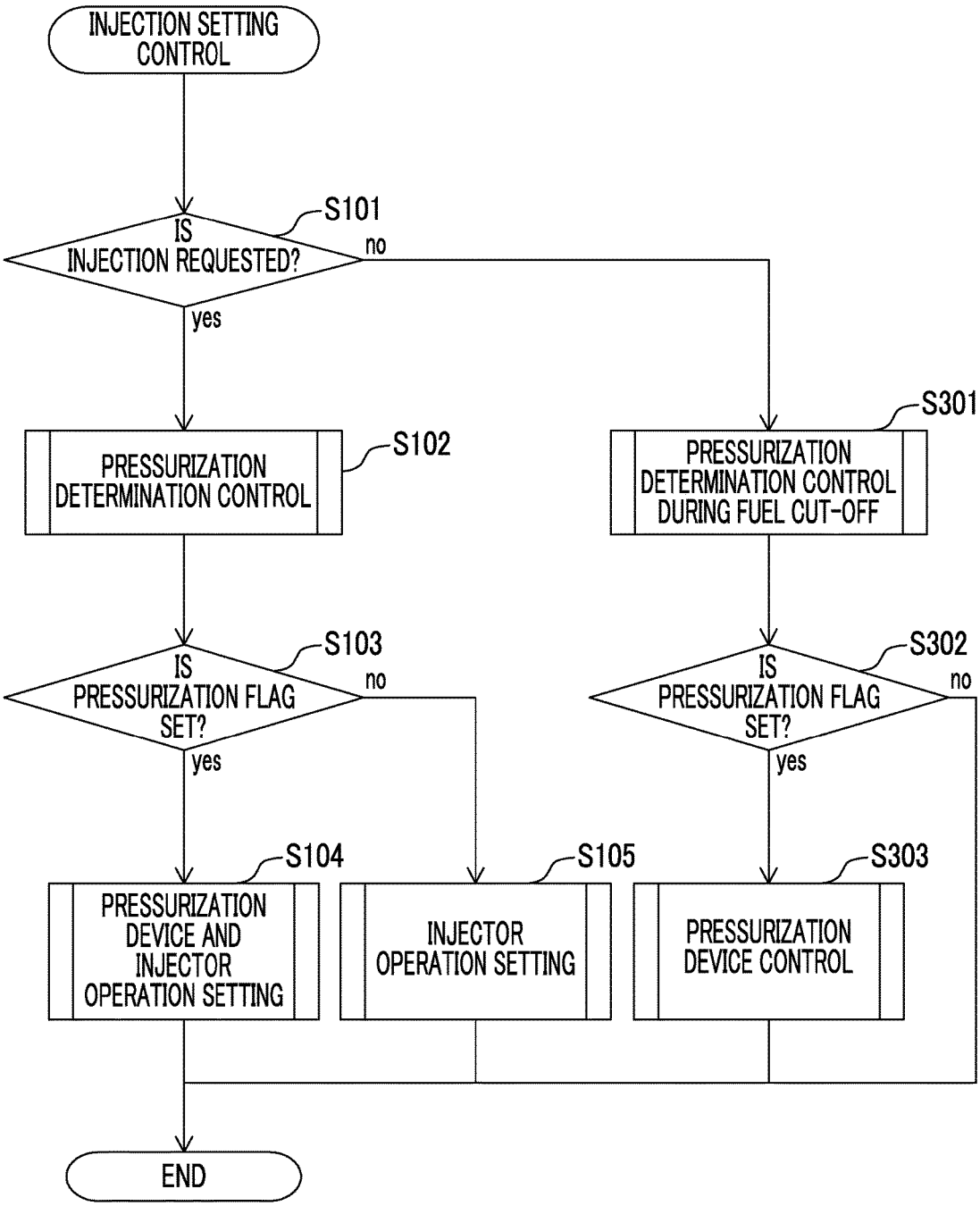
FIG. 11 is a flowchart illustrating a routine for setting a fuel injection operation in a third embodiment.

FIG. 11 illustrates a routine for setting, the fuel injection operation in the third embodiment. The routine is executed by an interruption per certain time period.

First, in step S101, the electronic control unit 20 determines whether or not fuel injection is needed. When the electronic control unit 20 determines that fuel injection is needed, that is, when an injection request is made, the electronic control unit 20 performs the process of step S102. When the electronic control unit 20 determines that fuel injection is not needed, that is, when an injection request is not made, the electronic control unit 20 performs a process of step S301. The control from step S102 is the same as the first embodiment and therefore, will not be described.

In step S301, the electronic control unit 20 determines whether or not the pressurization device 7 needs to be driven, and sets the pressurization flag in accordance with the determination. Step S301 and step S102 have the same function but are different from each other in that while step S102 assumes that fuel is injected, step S301 assumes that fuel is not injected (fuel cut-off). Step S301 will be described in detail below by using FIG. 12. When the process of step S301 is finished, a transition is made to step S302.

In step S302, the electronic control unit 20 determines whether or not the pressurization flag is set in step S301. When the pressurization flag is set, the electronic control unit 20 performs a process of step S303. When the pressurization flag is reset, the electronic control unit 20 finishes the process of the routine.

In step S303, the electronic control unit 20 drives the pressurization device 7 without fuel injection. At such time, the pressure of fuel supplied to the pressurization device 7, that is, the common rail pressure, is set to a sufficiently low pressure. Thus, driving the pressurization device 7 cools the pressurization device 7.

In such a case, fuel discharged from the pressurization device 7 is not discharged into the cylinder in the injector 9 and returns to the fuel tank 1 through the relief channel 11.

When the process of step S303 is finished, the process of the routine is finished.

Figure 12:
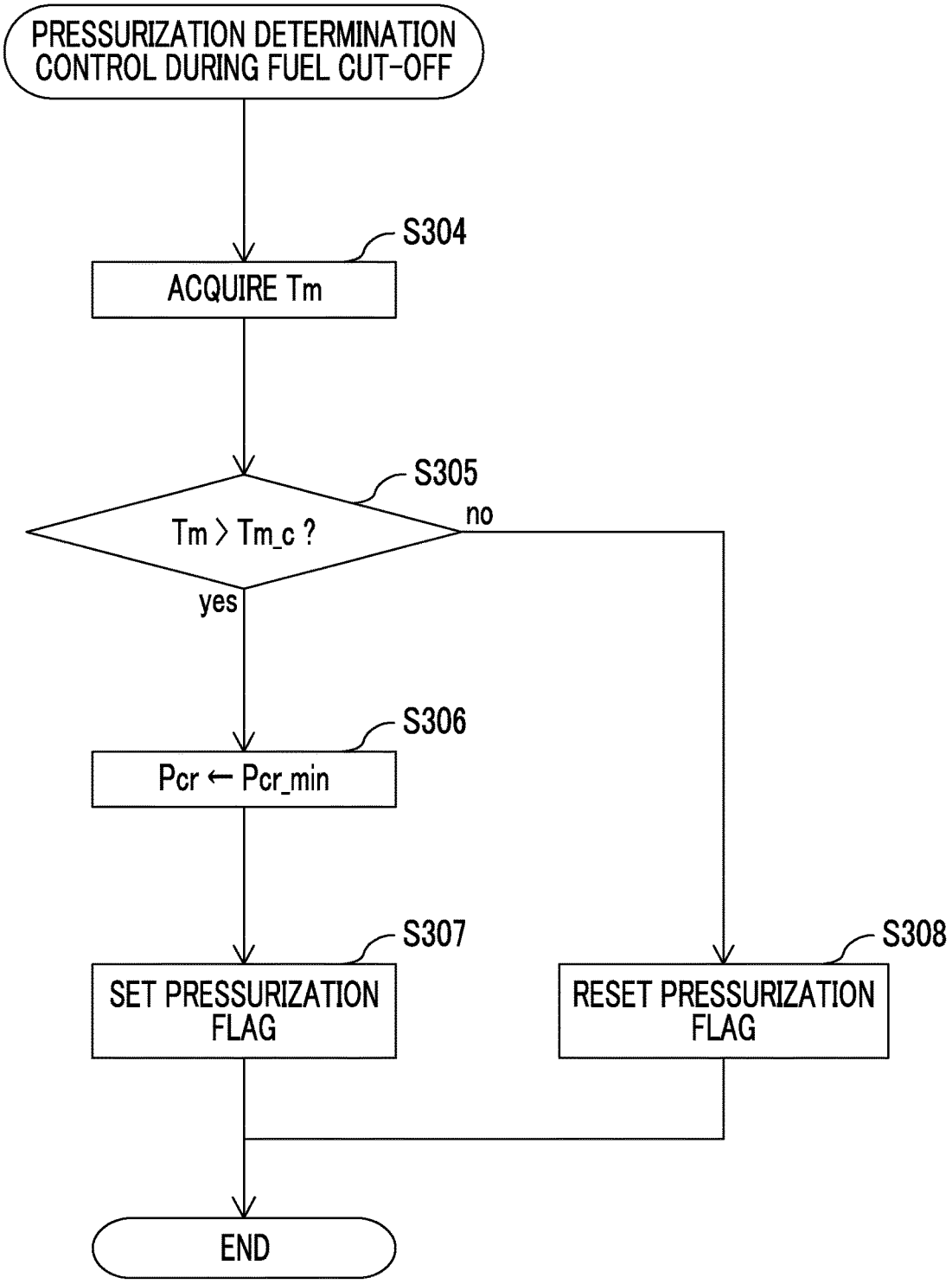
FIG. 12 is a flowchart illustrating a routine of pressurization determination control during a fuel cut-off in the third embodiment.

FIG. 12 illustrates a routine of pressurization determination control during a fuel cut-off in the third embodiment. The routine is executed each time the electronic control unit 20 executes step S301 in FIG. 11.

First, in step S304, the electronic control unit 20 measures the temperature Tm of the pressurization device 7. Then, in step S305, the electronic control unit 20 compares the temperature Tm of the pressurization device 7 with the predetermined cooling request temperature Tm_c. In step S305, when the temperature Tm of the pressurization device 7 is higher than the predetermined cooling request temperature, the electronic control unit 20 determines that pressurization needs to be performed by the pressurization device 7, and performs a process of step S306. When the temperature Tm of the pressurization device 7 is lower than or equal to the predetermined cooling request temperature Tm_c, the electronic control unit 20 determines that pressurization does not have to be performed by the pressurization device 7, resets the pressurization flag in step S308, and finishes the process of the routine.

In step S306, the electronic control unit 20 sets the target common rail pressure Pcr to a minimum common rail pressure Pcr_min that is a pressure lower than the common rail pressure set at the time of fuel injection. The estimated return channel temperature Tlp_p at the time of assuming that fuel having the minimum common rail pressure Pcr_min is supplied to the pressurization device 7, is set to be lower than the predetermined cooling request temperature Tm_c. That is, when the target common rail pressure Pcr is set to the minimum common rail pressure Pcr_min, the estimated return channel temperature Tlp_p can be estimated to be a temperature lower than the predetermined cooling request temperature Tm_c. For example, the minimum common rail pressure Pcr_min is approximately 10 MPa.

By setting the target common rail pressure Pcr to the minimum common rail pressure Pcr_min, the pressure of fuel supplied to the pressurization device 7 can be decreased. The temperature of fuel supplied to the return channel 10 can be decreased to the minimum, and the pressurization device 7 can be efficiently cooled.

Next, when the process of step S306 is finished, the electronic control unit 20 transitions to step S307 to set the pressurization flag, and finishes the process of the routine.

As described heretofore, according to the third embodiment, when a request for fuel injection is not made, and the temperature Tm of the pressurization device 7 is higher than the predetermined cooling request temperature Tm_c, the electronic control unit 20 (the control device for the internal combustion engine 100) sets the target common rail pressure Pcr (the target fuel pressure in the high pressure fuel channel) to the target common rail pressure Pcr (the target fuel pressure in the high pressure fuel channel) that causes the estimated return channel temperature Tlp_p (the fuel temperature in the low pressure fuel channel) to become lower than or equal to the predetermined cooling request temperature Tm_c. Then, the electronic control unit 20 controls the supply pump 3 to set the pressure of fuel within the common rail 5 (high pressure fuel channel) to the target common rail pressure (target fuel pressure). The electronic control unit 20 (the control device for the internal combustion engine 100) connects the pressurization control chamber 75 with the return channel 10 (low pressure fuel channel).

Since the pressurization device 7 can be cooled when a request for fuel injection is not made, the pressurization device 7 can be cooled more promptly than when the pressurization device 7 is cooled at the time of a request for fuel injection.

Fourth Embodiment

Next, a fourth embodiment of the present disclosure will be described. The difference between the fourth embodiment and the first embodiment is the control for determining whether or not to drive the pressurization device 7. More specifically, even when the set of the engine rotational speed NE and the requested injection amount Qv is present in the operating region (A), the pressurization device 7 is not driven when the temperature Tm of the pressurization device 7 is higher than the predetermined cooling request temperature Tm_c. Common parts in the first embodiment will not be described.

First, a routine for setting the fuel injection operation in the fourth embodiment uses the same routine as the first embodiment, that is, the routine in FIG. 6. Thus, the routine will not be described in detail.

Figure 13:
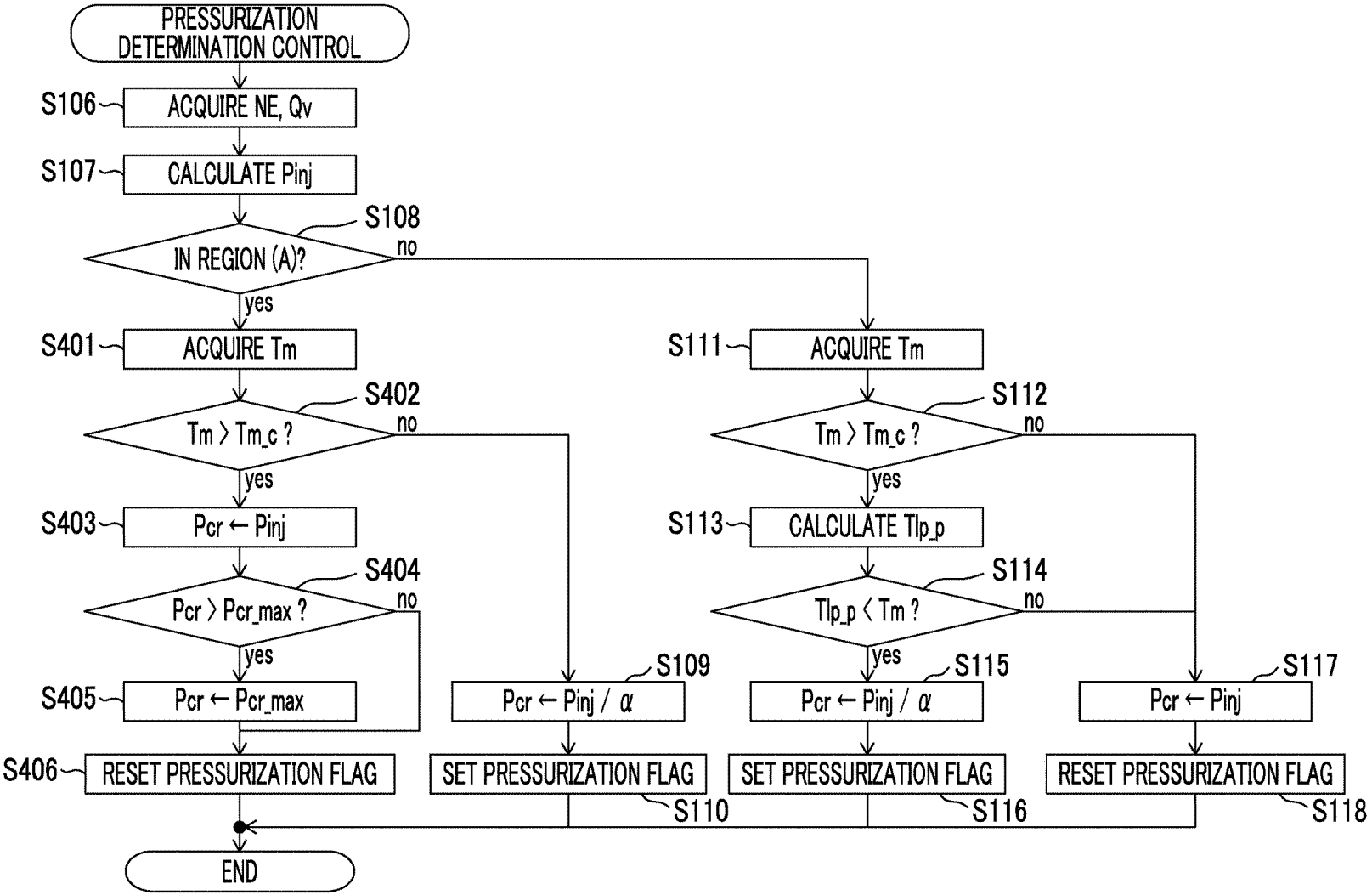
FIG. 13 is a routine of pressurization determination control in a fourth embodiment.

Next, the control for determining whether or not to drive the pressurization device 7 in the fourth embodiment will be described. FIG. 13 is a routine of pressurization determination control in the fourth embodiment. The routine is executed by an interruption per certain time period.

First, the electronic control unit 20 acquires the engine rotational speed. NE and the requested injection amount Qv in step S106 and then, calculates the requested injection pressure Pinj in step S107.

Then, the electronic control unit 20 in step S108 determines whether or not the set of the engine rotational speed NE and the requested injection amount Qv is included in the operating region (A) in the map (FIG. 4). When the set of the engine rotational speed NE and the requested injection, amount Qv is included in the operating region (A) in the map (FIG. 4), a transition is made to step S401. When the set of the engine rotational speed NE and the requested injection amount Qv is not included in the operating region (A) in the map (FIG. 4), a transition is made to step S111. The control from step S111 is the same as the first embodiment and therefore, will not be described.

Next, in step S401, the electronic control unit 20 measures the temperature Tm of the pressurization device 7 and performs a process of step S402, in step S402, the electronic control unit 20 compares the temperature Tm of the pressurization device 7 with the predetermined cooling request temperature Tm_c in order to determine whether or not to drive the pressurization device 7.

When the temperature Tm of the pressurization device 7 is higher than the predetermined cooling request temperature Tm_c, the electronic control unit 20 determines that the pressurization device 7 cannot be driven. The reason for such a determination is as follows. First, when step S402 is executed, the set of the engine rotational speed NE and the requested injection amount Qv is present in the operating region (A). In such a case, since both of the engine rotational speed NE and the requested injection amount Qv are large, the target common rail pressure Pcr is increased, and the estimated return channel temperature Tlp_p is also increased. That is, driving the pressurization device 7 in such a case heats the pressurization device 7. Accordingly, further heating should not occur when the temperature Tm of the pressurization device 7 is higher than the predetermined cooling request temperature Tm_c, that is, when the pressurization device 7 needs to be cooled. Thus, in step S402, the electronic control unit 20 prohibits driving of the pressurization device 7 when the temperature Tm of the pressurization device 7 is higher than the predetermined cooling request temperature Tm_c.

When the temperature Tm of the pressurization device 7 is higher than the predetermined cooling request temperature Tm_c in step S402, a transition is made to step S403. When the temperature Tm of the pressurization device 7 is lower than or equal to the predetermined cooling request temperature Tm_c, a transition is made to step S109 in order to drive the pressurization device 7. The processes from step S109 are the same as the first embodiment and therefore, will not be described.

Next, in step S403, the electronic control unit 20 sets the target common rail pressure Pcr to the injection fuel pressure Pinj. Next, in step S404, the electronic control unit 20 determines whether or not the target common rail pressure Pcr is higher than a maximum target common rail pressure Pcr_max that is the highest pressure of values acquired as the target common rail pressure Pcr. The target common rail pressure Pcr may be higher than the maximum target common rail pressure Pcr_max due to the following cause.

First, the target injection pressure Pinj may exceed the maximum target common rail pressure Pcr_max as a result of the electronic control unit 20 setting the target injection pressure Pinj assuming that the pressurization device 7 is operated. Since the target injection pressure Pinj higher than the maximum target common rail pressure. Pcr_max is set as the target common rail pressure Pcr in step S403, the target common rail pressure Pcr may be higher than the maximum target common rail pressure Pcr_max.

When the target common rail pressure Pcr is higher than the maximum target common rail pressure Pcr_max, the electronic control unit 20 executes a process of step S405. When the target common rail pressure Pcr is lower than or equal to the maximum target common rail pressure Pcr_max, the electronic control unit 20 executes a process of step S406.

In step S405, the electronic control unit 20 sets the target common rail pressure Pcr to the maximum target common rail pressure Pcr_max. By such a process, the target common rail pressure Pcr is set within a realizable range.

Lastly, in step S406, the electronic control unit 20 resets the pressurization flag, and the process of the present routine is finished.

For example, it is assumed that the temperature Tm of the pressurization device 7 is 160° C., that the target injection fuel pressure Pinj in the operating region (A) is 300 MPa, and that the maximum target common rail pressure Pcr_max is 250 MPa. In such a case, the electronic control unit 20 does not drive the pressurization device 7. Thus, the electronic control unit 20 temporarily sets the target common rail pressure Pcr to 300 MPa. However, since the target common rail pressure Pcr exceeds the maximum target common rail pressure Pcr_max, the electronic control unit 20 sets the target common rail pressure Pcr to 250 MPa again. In such a case, the pressure of fuel supplied to the injector 9 also becomes 250 MPa.

When the electronic control unit 20 executes step S405, the pressure of fuel supplied to the injector 9 is changed. Thus, the target injected fuel amount Qv may not be achieved. When the electronic control unit 20 executes step S405, the electronic control unit 20 may perform adjustment to satisfy the target injected fuel amount Qv by setting an injection condition such as increasing fuel by increasing the number of injections.

As described heretofore, according to the fourth embodiment, the return channel temperature Tlp_p (the fuel temperature in the low pressure fuel channel) refers to the temperature of fuel flowing in the return channel 10 that is estimated by assuming that the pressurization control chamber 75 and the return channel 10 (low pressure fuel channel) are connected to each other. When the return channel temperature Tlp_p (the fuel temperature in the low pressure fuel channel) is higher than the temperature Tm of the pressurization device 7, and the temperature Tm of the pressurization device 7 is higher than the predetermined cooling request temperature Tm_c, the electronic control unit 20 (the control device for the internal combustion engine 100) does not connect the pressurization control chamber 75 with the return channel 10 (low pressure fuel channel).

Consequently, driving of the pressurization device 7 based on the connection between the pressurization control chamber 75 and the return channel 10 is prohibited, and further heating of the pressurization device 7 is reduced.

Fifth Embodiment

Next, a fifth embodiment of the present disclosure will be described. The fifth embodiment is a modification example of the second embodiment. More specifically, in the second embodiment, the map for determining whether or not to drive the pressurization device 7, which is selected by the electronic control unit 20 when the temperature Tm of the pressurization device 7 is high, is FIG. 8 in which the operating region (A) is present. In the fifth embodiment, the map for determining whether or not to drive the pressurization device 7 is FIG. 14 in which the operating region (A) is not present. A routine of the fifth embodiment is the same as the routine of the second embodiment and therefore, will not be described.

Figure 14:
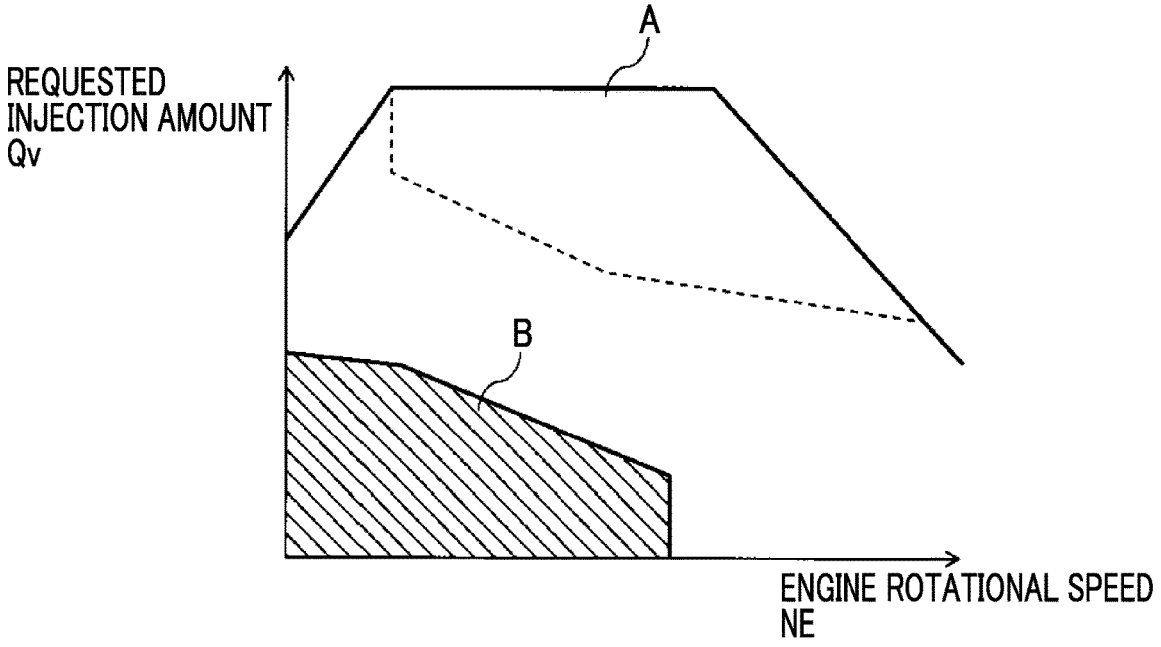
FIG. 14 is a map for determining need for driving the pressurization device in a fifth embodiment.

When the temperature Tm of the pressurization device 7 is higher than the predetermined cooling request temperature Tm_c, the electronic control unit 20 selects FIG. 14 as the map for determining whether or not to drive the pressurization device 7, thereby driving the pressurization device 7 for cooling and prohibiting driving of the pressurization device 7 for pressurization in the operating region (A) in which the pressurization device 7 is estimated to be heated. Accordingly, excessive heating of the pressurization device 7 is reduced.

In the present embodiment, when the target common rail pressure Pcr becomes higher than the maximum target common rail pressure Pcr_max, the target common rail pressure Pcr may be set to the maximum common rail pressure Pcr_max again in the same manner as the fourth embodiment.

As described heretofore, according to the fifth embodiment, the operating region (A) (second operating region) that determines the engine rotational speed NE and the target injected fuel amount Qv causing the return channel temperature Tlp (the fuel temperature in the low pressure fuel channel) to become higher than the predetermined cooling request temperature Tm_c is not set in the map in FIG. 14 (first map). The operating region (A) (second operating region) is set in FIG. 4 (second map). When the engine rotational speed NE and the target injected fuel amount Qv are included in the operating region (A) (second operating region) of the map selected from the map in FIG. 14 (first map) and the map in FIG. 4 (second map), the electronic control unit 20 connects the pressurization control chamber 75 with the return channel 10 (low pressure fuel channel).

Consequently, since the operating region (A) is not set in the map in FIG. 14 (first map) that is selected by the electronic control unit 20 when the pressurization device 7 needs to be cooled, excessive heating of the pressurization device 7 is reduced. Since the operating region (A) is set in the map in FIG. 4 (second map) that is selected by the electronic control unit 20 when the pressurization device 7 does not have to be cooled, pressurization can be appropriately performed to the extent not excessively increasing the temperature of the pressurization device 7.

What is claimed is:

1. A control system comprising:

an internal combustion engine including a fuel tank, a supply pump, a high pressure fuel channel in which fuel increased in pressure by the supply pump flows, a pressurization device, a low pressure fuel channel in which fuel returning to the fuel tank from the pressurization device without being increased in pressure by the pressurization device flows, and a fuel injection device, the supply pump being configured to increase a pressure of fuel retained in the fuel tank, the fuel injection device being configured to inject fuel increased in pressure by the pressurization device, the pressurization device being configured to increase the pressure of fuel supplied from the high pressure fuel channel, the pressurization device including a housing, a piston, a pressurization chamber defined by a first end of the piston and the housing, a piston chamber defined by a second end of the piston and the housing, a pressurization control chamber defined by the piston and the housing and disposed between the pressurization chamber and the piston chamber, and a switching device, the housing having a cylindrical shape, the piston reciprocatingly movably accommodated within the housing, the piston being configured to pressurize fuel within the pressurization chamber by using the pressure of fuel supplied from the high pressure fuel channel to the piston chamber, the pressurization chamber being filled with fuel that is discharged toward the fuel injection device the pressurization control chamber being configured to discharge fuel that is supplied from the high pressure fuel channel to the low pressure fuel channel during pressurization of fuel in the pressurization chamber, and the switching device being configured to selectively connect the pressurization control chamber with the high pressure fuel channel or the low pressure fuel channel; and a control device configured to estimate a temperature of the low pressure fuel channel, and the control device being configured to control the switching device to connect the pressurization control chamber with the low pressure fuel channel, when the estimated temperature of the low pressure fuel channel is lower than a temperature of the pressurization device and the temperature of the pressurization device is higher than a predetermined cooling request temperature.

2. The control system according to claim 1, wherein the control device is configured to:

calculate a target injection fuel pressure that is a target value of the pressure of fuel supplied to the fuel injection device from the pressurization device when fuel injection is requested;

calculate a target fuel pressure in the high pressure fuel channel based on the target injection fuel pressure; and estimate a fuel temperature in the low pressure fuel channel based on the target fuel pressure.

3. The control system according to claim 1, wherein the control device is configured to:

store a first map in which a first operating region determining an engine rotational speed and a target injected fuel amount causing a fuel temperature in the low pressure fuel channel to become lower than or equal to the predetermined cooling request temperature is set, and a second map in which the first operating region is not set;

select the first map when the temperature of the pressurization device is higher than the predetermined cooling request temperature;

select the second map when the temperature of the pressurization device is lower than or equal to the predetermined cooling request temperature; and connect the pressurization control chamber with the low pressure fuel channel when the engine rotational speed and the target injected fuel amount are included in the first operating region of the map selected from the first map and the second map.

4. The control system according to claim 1, wherein the control device is configured to:

set a target fuel pressure in the high pressure fuel channel to a target fuel pressure causing a fuel temperature in the low pressure fuel channel to become lower than or equal to the predetermined cooling request temperature, when the fuel injection device is not requested to inject fuel and the temperature of the pressurization device is higher than the predetermined cooling request temperature;

control the supply pump such that the pressure of fuel within the high pressure fuel channel is to be the target fuel pressure; and connect the pressurization control chamber with the low pressure fuel channel.

5. The control system according to claim 1, wherein the control device is configured not to connect the pressurization control chamber with the low pressure fuel channel, when the estimated fuel temperature in the low pressure fuel channel is higher than the temperature of the pressurization device and the temperature of the pressurization device is higher than the predetermined cooling request temperature.

6. The control system according to claim 3, wherein a second operating region that determines the engine rotational speed and a target injected fuel amount causing the fuel temperature in the low pressure fuel channel to become higher than the predetermined cooling request temperature is not set in the first map, the second operating region is set in the second map, and the control device is configured to connect the pressurization control chamber with the low pressure fuel channel when the engine rotational speed and the target injected fuel amount are included in the second operating region of the map selected from the first map and the second map.

* * * * *